US010178888B2

(12) United States Patent
Wetzel et al.

(10) Patent No.: US 10,178,888 B2
(45) Date of Patent: Jan. 15, 2019

(54) HEAD RESTRAINT SYSTEM HAVING A RATE SENSITIVE DEVICE

(71) Applicant: U.S. Army Research Laboratory ATTN: RDRL-LOC-I, Adelphi, MD (US)

(72) Inventors: Eric Dean Wetzel, Baltimore, MD (US); Greg Allan Thompson, Hockessin, DE (US); Jared Michael Gardner, Elkton, MD (US); Patrick Michael Toal, Jr., Bel Air, MD (US); Thomas Anthony John Plaisted, Forest Hill, MD (US); David Stanley Lowry, Oxford, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 77 days.

(21) Appl. No.: 15/366,578

(22) Filed: Dec. 1, 2016

(65) Prior Publication Data

US 2017/0150767 A1 Jun. 1, 2017

Related U.S. Application Data

(60) Provisional application No. 62/261,420, filed on Dec. 1, 2015.

(51) Int. Cl.

| | |
|---|---|
| ***A42B 3/06*** | (2006.01) |
| ***A42B 3/12*** | (2006.01) |
| ***A42B 3/04*** | (2006.01) |
| ***A63B 71/10*** | (2006.01) |

(52) U.S. Cl.
CPC ..... *A42B 3/0473* (2013.01); *A63B 71/10* (2013.01)

(58) Field of Classification Search
CPC .... F16F 13/08; F16F 13/002; A41D 31/0061; F41H 5/0471; F41H 5/0485; A42B 3/0473; A62B 35/00
See application file for complete search history.

(56) References Cited

U.S. PATENT DOCUMENTS

| | | | |
|---|---|---|---|
| 5,712,011 | A | 1/1998 | McMahon et al. |
| 6,385,781 | B1 | 5/2002 | Rose et al. |
| 7,402,147 | B1 | 7/2008 | Allen |
| 8,181,281 | B2 | 5/2012 | Nagely et al. |

(Continued)

OTHER PUBLICATIONS

X Z Zhang, W H Li, and X L Gong, "The rheology of shear thickening fluid (STF) and the dynamic performance of an STF-filled damper," Smart Mater. Struct. 17 (2008) 035027.

(Continued)

*Primary Examiner* — Bobby Muromoto, Jr.
(74) *Attorney, Agent, or Firm* — Eric Brett Compton

(57) ABSTRACT

A head restraint system having a rate sensitive device to connect a head restraint to a body of a user. The head restraint system includes a first connector to connect to the head of a user, a second connector connected to the first connector and to a body of the user, wherein one of the first connector and the second connector includes a rate sensitive (RS) device, wherein the first connector and the second connector are configured to restrain the user's head to the user's body at high speed motion of the user's head relative to the user's body and otherwise not restrain the user's head.

24 Claims, 14 Drawing Sheets

(56) References Cited

U.S. PATENT DOCUMENTS

| | | | | |
|---|---|---|---|---|
| 8,528,113 | B2 | 9/2013 | Siegler et al. | |
| 8,561,217 | B2 | 10/2013 | Nagely et al. | |
| 8,566,967 | B2 | 10/2013 | Janiss et al. | |
| 9,303,717 | B2 * | 4/2016 | Wetzel | F16F 13/002 |
| 2005/0266748 | A1 * | 12/2005 | Wagner | A41D 31/0061 442/59 |
| 2006/0234572 | A1 * | 10/2006 | Wagner | C08L 71/02 442/59 |
| 2006/0234577 | A1 * | 10/2006 | Wagner | A41D 31/0061 442/135 |
| 2006/0260027 | A1 * | 11/2006 | Rhodes | A42B 3/0473 2/421 |
| 2007/0246979 | A1 * | 10/2007 | Browne | A47C 7/38 297/216.12 |
| 2016/0178027 | A1 * | 6/2016 | Wetzel | A61F 5/0125 267/73 |
| 2016/0320278 | A1 | 11/2016 | Chan et al. | |

OTHER PUBLICATIONS

DARPA, "Warrior Web to Prevent Injury, Reduce Effects of Load," Oct. 5, 2011. (Previously Available at: http://www.darpa.mil/NewsEvents/Releases/2011/10/05.aspx; copy retrieved Jun. 4, 2013).

DARPA: Defense Sciences Office, "Warrior Web," Nov. 16, 2011. (Previously Available at: http://www.darpa.mil/Our-Work/DSO/Programs/Warrior-Web.aspx; copy retrieved Jun. 25, 2013).

MidYear Progress Report for NFL Head Health Challenge II: Shear-Thickening Fluid (STF) Tethers for Mitigation of Head Accelerations During Collisional Football Events; Report dated: Mar. 31, 2015.

Final Progress Report for NFL Head Health Challenge II: Shear-Thickening Fluid (STF) Tethers for Mitigation of Head Accelerations During Collisional Football Events; Report dated: Aug. 17, 2015.

Capitol Hill Technology Briefing on NFL Head Health Challenge: Presentation at event entitled Gizmos, Gadgets, and America's Game: How Technology is Advancing Health and Safety in the NFL, was sponsored by Congressmen Tom Rooney and Bill Pascrell, Co-Chairs of the Congressional Brain Injury Task Force. (Jun. 25, 2015).

Capitol Hill Technology Briefing on NFL Head Health Challenge: Presentation at event entitled Gizmos, Gadgets, and America's Game: How Technology is Advancing Health and Safety in the NFL, was presented to the House Energy and Commerce Committee, chaired by Fred Upton and to the Senate Commerce Committee, chaired by Senator John Thune. (Sep. 9, 2015).

Elliot J. Pellman, M.D. et al., "Concussion in Professional Football: Reconstruction of Game Impacts and Injuries," Neurosurgery 53:799-814, 2003.

J.A. Newman et al., "Verification of biomechanical methods employed in a comprehensive study of mild traumatic brain njury and the effectiveness of American football helmets," Journal of Biomechanics 38 (2005) 1469-1481.

* cited by examiner

1100

310
304

310
1104
304

206
412
304
1102
208
flexible, inextensible tether
rate-sensitive tether
rigid structure 310
304

1106
304
304

304
1102

HEAD RESTRAINT SYSTEM HAVING A RATE SENSITIVE DEVICE

CROSS-REFERENCE TO RELATED APPLICATIONS

This application claims the benefit of U.S. Provisional Patent Application No. 62/261,420 filed on Dec. 1, 2015, the contents of which, in its entirety, is herein incorporated by reference.

GOVERNMENT INTEREST

The embodiments herein may be manufactured, used, and/or licensed by or for the United States Government without the payment of royalties thereon.

BACKGROUND

Technical Field

The embodiments herein generally relate to rate sensitive devices and a rate sensitive systems, and more particularly to a head restraint system having a rate sensitive device to provide free movement of the head, but restrain the head to the body during impacts.

Description of the Related Art

While the science of concussion and traumatic brain injury (TBI) is incomplete, there is reasonable consensus that these injuries correlate with high values of head acceleration. When the head is accelerated (or decelerated) quickly, it can place strains and stresses on the brain which lead to brain injury. Therefore, technologies that reduce head accelerations are likely to reduce the likelihood and severity of brain injury.

SUMMARY

In view of the foregoing, an embodiment herein provides a head restraint system comprising a first connector configured to connect to a head of a user; a second connector connected to the first connector and configured to connect to a body of the user, wherein one of the first connector and the second connector comprises a flexible rate sensitive (RS) device, wherein the first connector and the second connector are configured to not restrain relative motion between the head and the body, and to restrain relative motion between the head and the body during impact.

An embodiment herein provides a head restraint system comprising a first connector configured to operatively connect to a head of a user; and a second connector operatively connected to the first connector and configured to operatively connect to a body of the user, wherein any of the first connector and the second connector comprises a flexible rate sensitive device, wherein the first connector and the second connector are configured to not restrain relative motion between the head and the body during a motion of a first velocity, and to restrain relative motion between the head and the body during a motion of a second velocity, and wherein the motion of the second velocity is greater than the motion of the first velocity.

The rate sensitive device may comprise a shear thickening fluid. The rate sensitive device may comprise a combination of an elastically-deformable confinement member, internal filaments, and enclosed shear thickening fluid. The rate sensitive device may comprise an inertial clutch. The other one of the first connector and the second connector may comprise an inextensible device. The system may further comprise a helmet configured to be disposed on the head of the user, wherein the first connector is operatively connected to the helmet. The system may further comprise a rail connected to the helmet; and a mechanism slideably coupled to the rail, wherein the first connector is operatively connected to the mechanism.

The system may further comprise a facemask operatively connected to the helmet, wherein the rail may comprise a curved section and is disposed between the facemask and a face position of the user when the helmet is disposed on the head of the user. The system may further comprise a facemask operatively connected to the helmet, wherein the rail may comprise a curved section, is operatively connected to the facemask, and extends around the helmet in a transverse plane of the helmet. The system may further comprise at least one rail support to operatively connect the rail to the helmet at another location. The at least one rail support may comprise a helmet raised central band that conforms to an outer surface of the helmet, and is disposed in substantially a sagittal plane of the helmet. The helmet raised central band may comprise an energy-absorbing element disposed on an outer surface of the helmet, and wherein the energy absorbing element comprising at least one of foam, honeycomb walls, and trusses.

The mechanism may comprise a yoke comprising a plurality of first attachments slideably disposed on the rail, and a second attachment opposed to the plurality of first attachments operatively connected to the first connector. The first connector may comprise a plurality of first connectors, and wherein the mechanism may comprise a yoke comprising a first attachment slideably connected to the rail, and a plurality of second attachments each connected to the first connector, and opposed to the first attachment. The second connector may operatively connect to a garment configured to be worn on the body of the user.

The garment may comprise a sheath, wherein at least one of the first connector and the second connector is movably disposed in the sheath, and wherein the sheath is configured to guide the at least one of the first connector and the second connector along body contours of the user. The garment may comprise the flexible rate sensitive device that is configured to lengthen at a first predetermined loading rate and resist lengthening at a second predetermined loading rate, wherein the first predetermined loading rate is lower than the second predetermined loading rate, and wherein the flexible rate sensitive device may comprise a strap. The garment may comprise a body connector configured to couple to at least one of a shoulder, a ribcage, a thorax, a waist, a pelvis, a hip, and a thigh of the user. The body connector may comprise at least one of an adjustable strap and a conformal sleeve configured to tighten to the body of the user when placed under tension. At least one of the first connector and the second connector may be configured to be disposed along at least one of a front of the body of the user, a back of the body of the user, and a side of the body of the user.

The relative motion of the head relative to the body may comprise a head rotation in any of a transverse, sagittal, and frontal plane, wherein the first velocity and the second velocity comprise an angular velocity. The first velocity may be less than approximately 25 rad/s, and the second velocity may be greater than approximately 0.25 rad/s.

The relative motion of the head relative to the body may comprise a linear displacement of the head relative to the body, wherein the first velocity and the second velocity comprise a linear velocity. The first velocity may be less than approximately 5 m/s, and the second velocity may be greater than approximately 0.05 m/s.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1A:
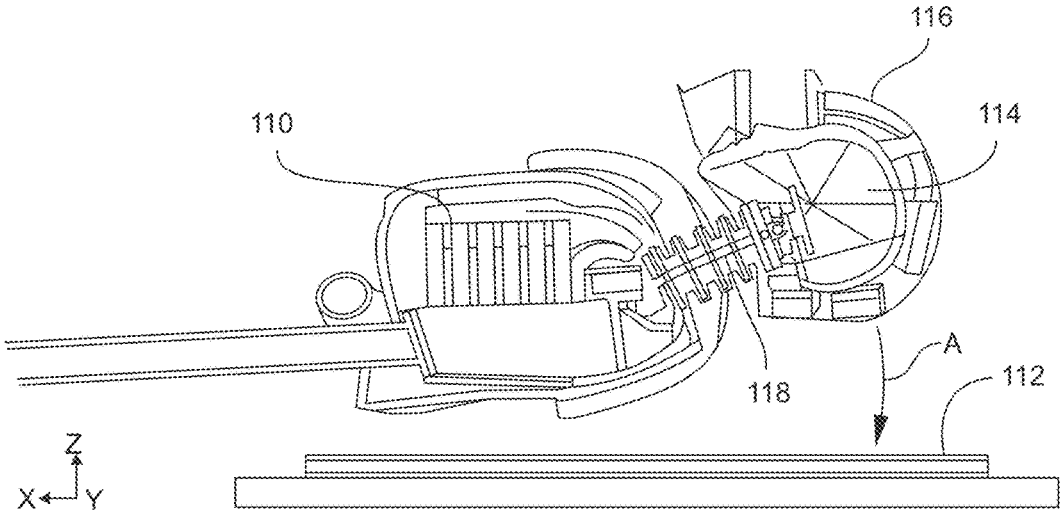
FIG. 1A present a finite element model simulating a football player falling backwards, with the rear of the head striking the ground violently.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

It will be understood that for the purposes of this disclosure, "at least one of X, Y, and Z" can be construed as X only, Y only, Z only, or any combination of two or more items X, Y, and Z (e.g., XYZ, XYY, YZ, ZZ). Referring now to the drawings, and more particularly to FIGS. 1A through 14, where similar reference characters denote corresponding features consistently throughout the figures, there are shown preferred embodiments.

Figure 1B:
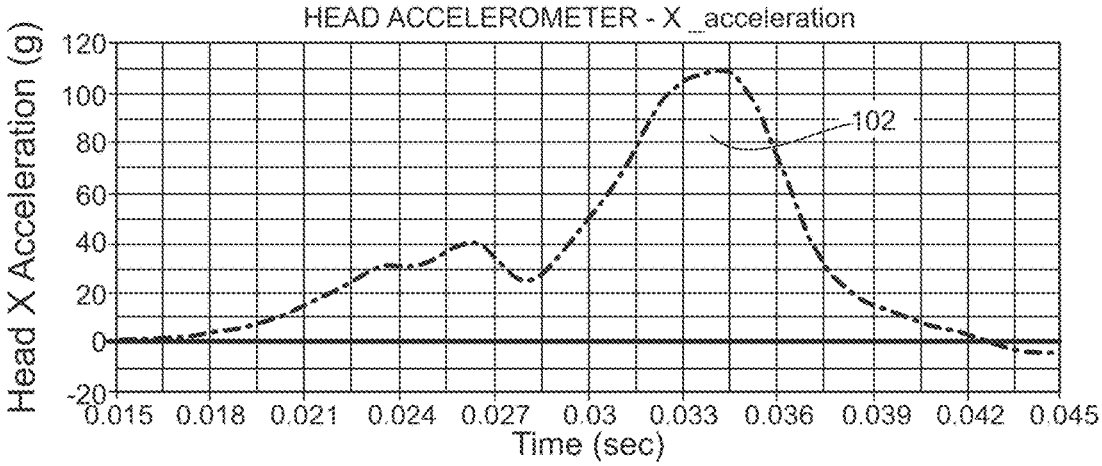
FIG. 1B is a graphical illustration of the results of the finite element model of FIG. 1A showing that a peak head x acceleration at about 0.034 seconds can be about 100 g.

Exemplary embodiments herein provide systems and devices to tether the head to the torso to limit head motion and reduce head accelerations. The large mass of the torso, if coupled to the head, can provide inertial resistance to sudden motion of the head. As shown in FIGS. 1A and 1B, this approach can be particularly useful for backwards falls, where an individual falls on his/her back, causing a rearward head whip (arrow A) that drives the back of the head 114 into the ground 112. Since the torso (body) 110 tends to strike the ground 112 before the head 114 in these backwards falls, the body 110 comes to rest before the head 114, and a tether between the body 110 and head 114 can be very effective at slowing the head 114 as it approaches the ground 112. The head 114 is shown inside a helmet 116 in the diagram of FIG. 1A. The neck 118 is also shown, and the helmet 116 can be tethered to the body 110 in order to tether the head 114 to the body 110. The head acceleration is not limited to 100 g. The head acceleration can be greater or less than 100 g during impact as shown in the graph 102 in FIG. 1B. Several factors that influence head acceleration during impact include initial conditions, impact surface, helmet, and the like. While not wishing to be limited by theory to 100 g, data results from football players suffering head impacts, such as backfall, during game conditions suggests 100 g head acceleration commonly results in a concussion, whereas a head acceleration significantly less than 100 g is much less likely to result in a concussion.

Figure 2:
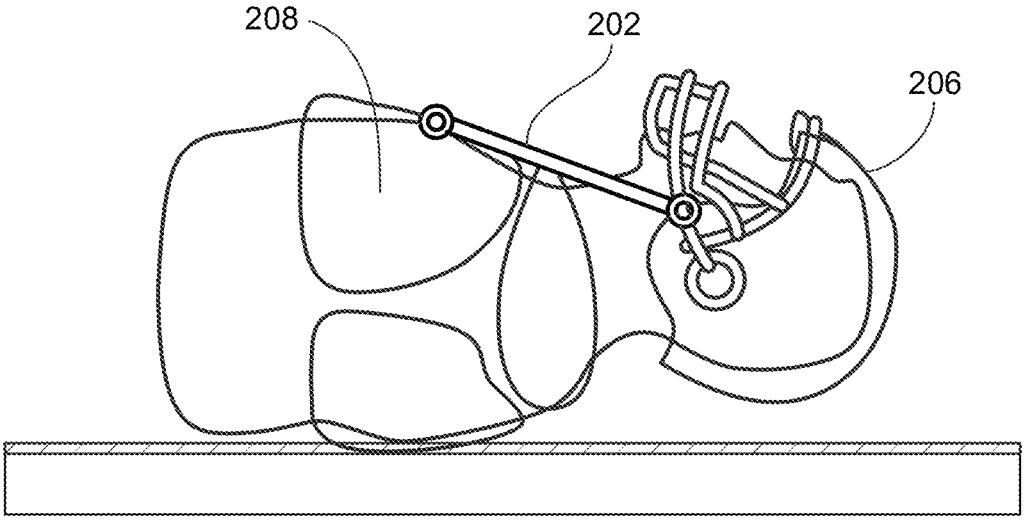
FIG. 2 shows a schematic view of a comparative head to body restraint system.

As shown in FIG. 2, with reference to FIGS. 1A and 1B, attaching an inextensible strap 202 between the helmet 206 and the torso 208 can be effective at controlling head motion and limiting head accelerations. However, such a configuration may also constrain the head from voluntary motion, such as the deliberate up-down and side-to-side head motions for looking around and executing normal overall body motions.

An approach for allowing voluntary head motion while restricting sudden head motions is to use head-to-body tethers that are sensitive to an extension rate such as rate-dependent, elastically-deformable devices, as set forth in commonly owned U.S. Pat. No. 9,303,717, filed Jun. 26, 2013, and U.S. patent application Ser. No. 15/057,944, filed Mar. 1, 2016, the complete disclosures of which are hereby incorporated by reference for all purposes as if fully set forth herein. These head-to-body tethers that are sensitive to extension rate can comprise an elastomeric tube with enclosed filaments or ribbons, and shear thickening fluid (STF). At low deformation rates, the STF has low viscosity, and permits the tether to extend with low resistive force. At high deformation rates, the STF becomes solid-like, gripping the filaments or ribbons, and causing the tether to resist extension with high force. Other rate sensitive tethering can exploit inertial effects, such as in an inertial clutch-cable system similar to those used in automotive seatbelts.

A head restraint system according to exemplary embodiments herein provides head-to-body coupling in a highly functional and practical manner, both with respect to injury prevention and permitting natural voluntary motion. These exemplary embodiments reduce the likelihood or severity of concussions by controlling head motion during sports, such as football, hockey, lacrosse, skateboarding, and motorsports, among others applications including non-sports activities. These exemplary embodiments are equally applicable to preventing or reducing a wider range of injuries associated with violent head motion, including whiplash, neck hyperextension, and skull fracture. The exemplary embodiments described herein do not restrain voluntary or intentional relative motion between the head and the body of a user, but do restrain involuntary, inertial, high rate relative motion between the head and the body of the user such as during impact or rapid deceleration, such as results from backfall. Again, these exemplary embodiments also apply to other activities, for example, parachute landing. For example, paratroopers have a higher rate of concussion compared to non-parachuting soldiers, due primarily to head-to-ground impacts during landings.

Figure 3:
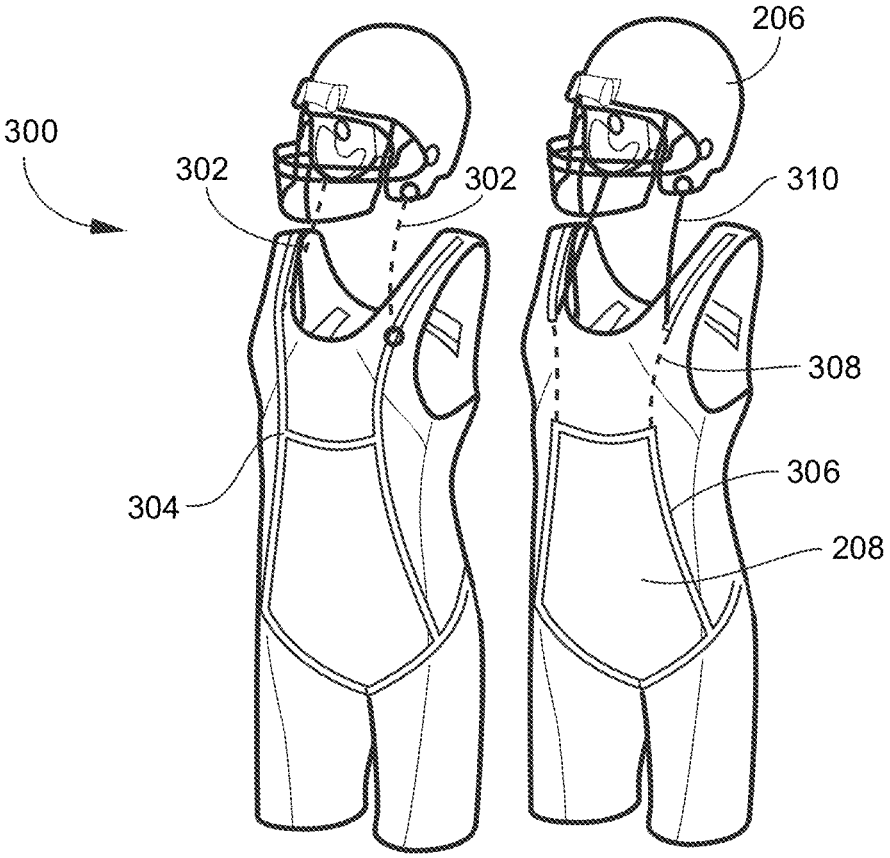
FIG. 3 shows schematic views of a head restraint system to reduce head concussions according to exemplary embodiments herein.

FIG. 3, with reference to FIGS. 1A through 2, shows a schematic drawing illustrating features of a protective ensemble according to exemplary embodiments herein. The helmet 206 is connected to the body 208 via a series of flexible rate sensitive tethers and inextensible tethers. The rate sensitive elements can be positioned directly between the helmet and body suit, or integral to the body suit with inextensible tethers connected directly to the integral rate sensitive elements and the helmet. In both cases, a sudden motion will create high resistance in the rate sensitive tethers, resisting helmet and head motion. In the latter case, with the rate sensitive tethers integrated into the body suit, comfort may be improved since the suit can continuously conform to the body of wearer.

In FIG. 3 the protective ensemble comprises a head restraint system 300 to reduce the probability of a head concussion of a user. The system 300 comprises a first connector 302 configured to connect to the head of the user, and in these embodiments, the first connector 302 is connected to the helmet 206 to be worn by the user. A second connector 304 is connected to the first connector 302 and is configured to be connected to the user's body 208. As illustrated on the left side of FIG. 3 by a dashed line, the first connector 302 can include a flexible rate sensitive (RS) device, such as a rate sensitive tether, and the second connector 304 can be an inextensible device, such as a nylon tether. The first connector 302 can include a plurality of rate sensitive devices and the second connector 304 can include a plurality of inextensible devices, such as nylon tethers, body harness as shown, and the like. As illustrated on the right side of FIG. 3 by a dashed line, a second connector 306 can include a flexible rate sensitive (RS) device 308, such as a rate sensitive tether, and a first connector 310 can be an inextensible device, such as a nylon tether. Further, both the first connector 302, 310 and the second connector 304, 306, 308 can include both a rate sensitive device and an inextensible device such as a rate sensitive tether in series with an inextensible tether.

Figure 4:
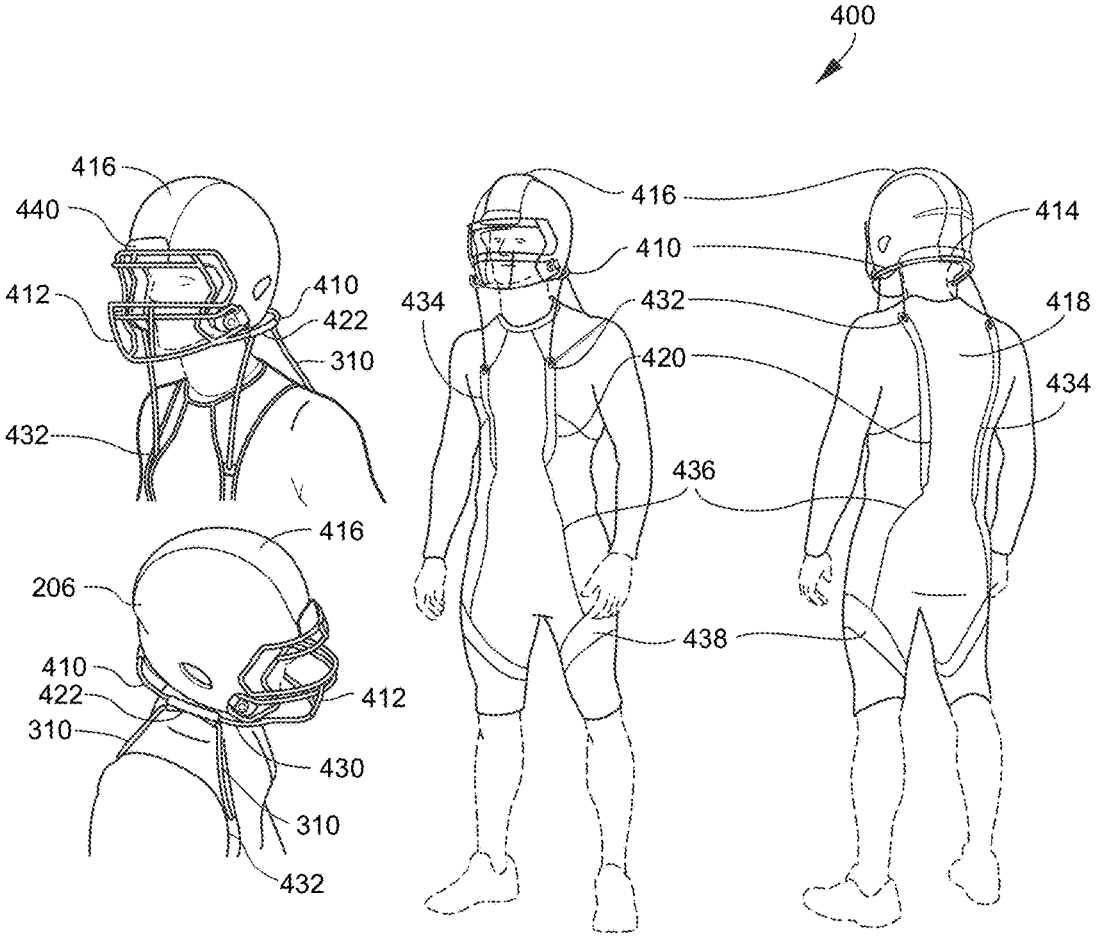
FIG. 4 shows schematic views of a head restraint system to reduce head concussions according to exemplary embodiments herein.

FIG. 4, with reference to FIGS. 1A through 3, is a schematic diagram of a head restraint system 400 to reduce head concussions according to exemplary embodiments herein. The system 400 comprises a helmet 206 and transverse circumferential helmet ring 410 that may be attached to a facemask 412 in the front of the helmet 206. The helmet ring 410 can be attached at the back of the helmet 206 to a posterior portion (support) 414 of a raised central band 416 that extends along the outer surface of the helmet 206 in the sagittal plane to attach an anterior portion thereof to the top of the facemask 412. The system 400 also comprises a body suit (garment) 418 with rate actuated straps (second connectors) 420 tethered to the helmet ring 410 directly or by inextensible straps 310 as shown.

While the exemplary embodiment of the system 400 is illustrated for a football application, the head restraint system 400 herein is not so limited, and can be utilized in other applications as mentioned above. Here, the rate sensitive devices may be referred to as rate actuated straps or tethers. According to some of these embodiments, the system 400 can control head motion by transmitting restraint forces from the user's body 308 via the body suit 418 to the helmet 206. Some of these embodiments can be retrofitted to a helmet 206 to provide more rapid adaptation by users. For example, the helmet ring 410 coupled to the facemask 412 can be adapted by retrofitting a conventional helmet with the facemask 412 and helmet ring 410 of these embodiments. Facemasks can be replaced separately from a helmet and at a substantially reduced cost compared to replacing an entire helmet providing an efficient and economical solution to reducing and eliminating head concussions.

In these exemplary embodiments the first connectors 310, for example, head-to-body straps, slideably ride along the helmet ring 410, so that side-to-side head rotations are free and do not load the head-to-body straps (first connectors) 310, but forward or rearward head tilt would load the straps (first connectors) 310 and restrict motion. Although the helmet ring 410 has been described as a ring, it is not so limited and can be a track, rail, and/or other guide or mechanism for a slideable connection with the first connector 310. The raised central band 416 that connects the top front of the facemask 412 to the helmet ring 410 at the rear of the helmet 206 can be added to the helmet 206 or be integrally formed with the helmet 206. The raised central band 416 can be disposed on the outer surface of the helmet 206 and have low sidewalls to provide a relatively low profile of rigid material. Since this raised central band 416 covers much of the front and crown of the helmet shell, which are common striking areas during head-to-head collisions, energy absorbing material, such as foam (not shown), may be disposed between the raised central band 416 and the helmet outer shell to further decrease impulse loading during impacts.

As illustrated in FIG. 4, the head-to-body straps (first connectors) 310 are coupled to the helmet ring 410 via a sliding strap truck 422. This truck 422 allows free transverse plane rotation of the helmet 206, but during head tilt forces the straps (first connectors) 310 to engage the helmet 206. By maintaining a consistent spacing between the ends of the straps (first connectors) 310, the truck 422 ensures that the straps (first connectors) 310 will be engaged during head tilt rather than closing or opening their spacing without stretching at low loading rates or transferring the load at high loading rates. The head-to-body straps (first connectors) 310 can be configured as relatively conventional, inextensible, flexible straps or tethers. The rate actuated straps (second connectors) 420 in some of these embodiments are part of an integrated body suit 418 to provide the rate-triggered restraining action.

For example, the body suit (garment) 418 can comprise a sheath 434 and at least one of the first connector 310 and the second connector 420 is movably disposed in the sheath 434, and wherein the sheath 434 is configured to guide the at least one of the first connector 310 and the second connector 420 along body contours of the user. Here, the body suit 418 can comprise a rate sensitive strap 420 that lengthens at low loading rates, but resists lengthening at high loading rates and the body suit 418 can comprise a body connector 436 configured to couple to at least one of a pelvis, a hip, and a thigh of the user. The body connector 436 can comprise at least one of an adjustable strap and a conformal sleeve, such as a conformal harness 438 configured to tighten to the user's body 208 when placed under tension.

The body suit 418 with integrated rate sensitive (RS) device (second connector) 420 provides a balance between performance and comfort. Body harnesses of various types are commercially available, such as an electrical linesman harness, parachute harness, or climbing harness. These systems are generally designed to statically support body weight, and are therefore composed of inextensible straps (typically nylon web). In most cases, these harnesses are worn somewhat loosely, to minimize stress concentrations or rubbing that could cause discomfort. For application to a head restraint system (e.g., system 400) to reduce head concussions according to exemplary embodiments herein, the body suit 418, in order to resist the forces on the helmet 206 and head, as transmitted via the head-to-body tethers must be snug at all times, so that sudden forces are instantly resisted. There should be no or minimal looseness in the load path any looseness in the load path will decrease the system's efficiency in slowing down the head before it strikes the ground. However, wearing a conventional rigid body suit tightly would be uncomfortable, and could induce rubbing/chaffing injuries in the pelvis/groin area during running. Accordingly, some of the exemplary embodiments herein provide a body suit 418 in which the rate sensitive straps 420 are part of the load path of the body suit 418. The rate sensitive strap suit 418 provides self-adjustment, because it can constantly extend and contract at relatively slow speeds to continuously accommodate the body position of the wearer. However, if a sudden load is applied to the suit 418, then the rate sensitive straps 420 will stiffen and resist the load. In short, the body suit 418 transforms from conformable to resistive only upon the sudden application of force.

A number of advantages arise from integrating the rate sensitive straps (second connectors) 420 into the body suit 418. For example, the straps 420 can be worn close to the body, and therefore can be protected by shoulder and chest pads and the outer jersey, lessening the likelihood that the straps 420 will be exposed to snagging, abrasion, or other physical insult that could damage the straps. In another example, by hiding the rate sensitive straps 420 in the body suit 418, there is less burden on the straps 420 to look aesthetically pleasing; instead, inextensible straps (first connectors) 310 emerge from the body suit 418 at an opening or guide 430, 432 to connect to the helmet 206, and these straps 310 can be mechanically robust and look fashionable by using conventional materials. As a still further example, the large area and relatively flat surface of the torso of the user allows a longer and larger rate sensitive strap to be employed compared to a strap that would emerge from the body. As an even further example, keeping the rate sensitive straps close to the body can keep them close to body temperature, so rate sensitive strap will not be exposed to extremely hot or cold temperatures, and therefore is more likely to provide consistent performance.

A conventional body harness loops under the pelvis, taking advantage of the relatively incompressible spine-to-pelvis column. However, stress concentrations in the pelvis/groin area can be uncomfortable. Accordingly, some of these exemplary embodiments provide a restraining garment that is similar in appearance and fit to high performance compression shorts, while providing resistance to upward motion, while distributing the load more evenly over the pelvis and thighs compared to a conventional harness. For example, in some embodiments the connectors 310, 420 are anchored to a compression suit that hugs the body and distributes the load more evenly over the shoulders, the upper arms, the ribcage, the thorax, the waist, the hips, the thighs, the pelvis, and the like, and combinations thereof. In this sense, the second connector 420 may be a series of webbed pelvis/thigh straps, comprising at least one of an inextensible strap material and a rate sensitive strap material.

According to some further exemplary embodiments, a conventional helmet chinstrap can be eliminated. The head-to-body tether system as described herein can effectively keep the helmet on the head of the wearer, making the chinstrap redundant. However, in other exemplary embodiments, the helmet chin strap may be retained. Eliminating the chinstrap could be an important improvement in user comfort, as the chinstrap can be a source of discomfort. The chinstrap can also hamper the user talking, an issue that may be critical in military applications. Further, though not wishing to be bound by theory, it is noted in some studies that helmet loads can be transmitted to the head via the chinstrap, so that eliminating the chinstrap may reduce the likelihood or severity of head injury for certain head blows.

Figure 5A:
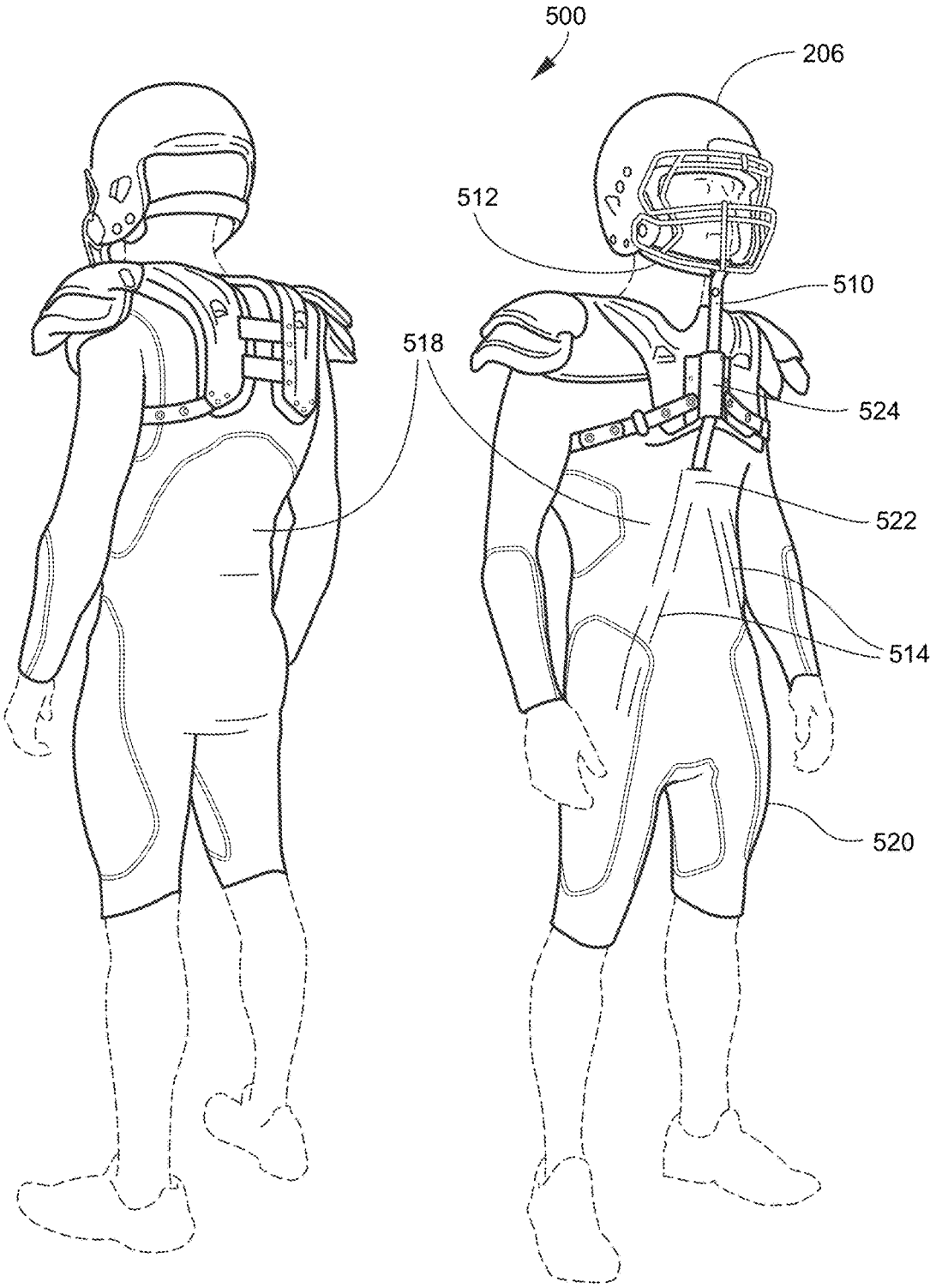
FIGS. 5A, 5B, and 5C show schematic views of a head restraint system to reduce head concussions according to exemplary embodiments herein.
Figure 5B:
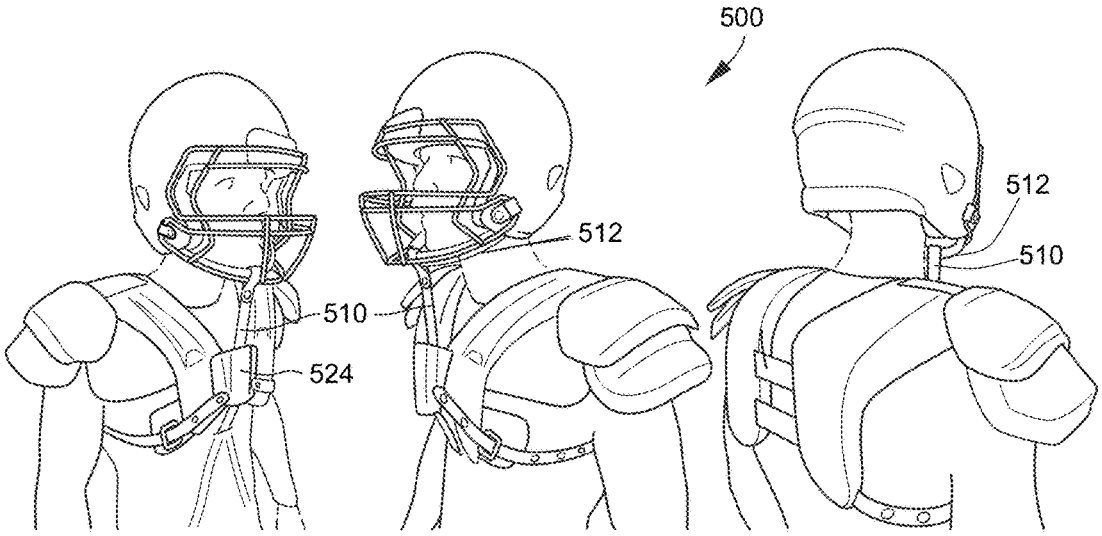
Figure 5C:
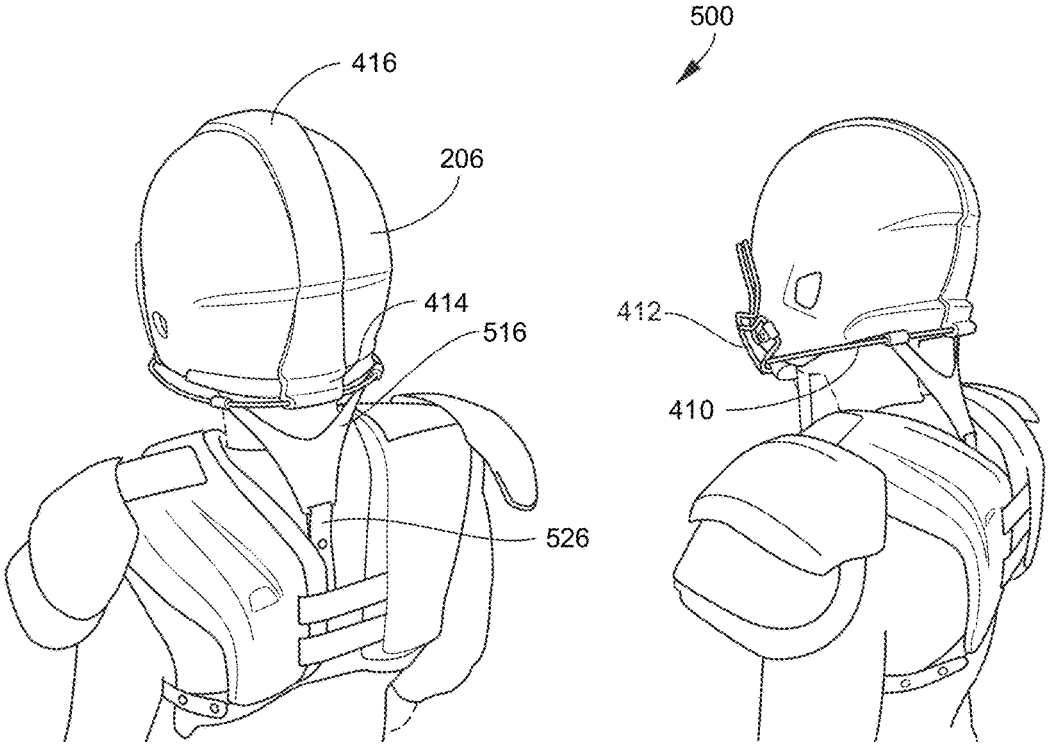

According to some exemplary embodiments herein a first and/or second connector routing from the body to the helmet can be disposed along the user center-line, for example, along the user's sternum and/or spine. FIGS. 5A, 5B, and 5C, with reference to FIGS. 1A through 4, are schematic diagrams of a head restraint system 500 to reduce head concussions according to exemplary embodiments herein. FIG. 5A shows a front view and a back view of a first connector (strap) 510 connected to a user's helmet 206 via a mandible rail 512 at one end and connected at a yoke 522 (inside the suit 518) to a second connector 514 after passing through a guide 524 at the other end. The second connector 514 comprises two rate sensitive tethers mounted within a body suit 518 that connect to load anchors 520 of the body suit 518, such as load anchoring in the pelvis. A rear yoke 516 can be connected to a helmet ring 410, and the helmet ring 410 is attached to the facemask 412 and a support 414 on a posterior portion of a raised central band 416 that extends along the outer surface of the helmet 206 in the sagittal plane according to some of these exemplary embodiments.

According to some of these exemplary embodiments, advantages are achieved in the system performance by mounting the tethers in front of the head, for example at the tip of the facemask 412, rather than along the neck near the earholes.

Routing the body straps to the helmet, along the sides of the neck can be challenging. Specifically, for conventional shoulder pad systems, there is very little gap between the shoulder pads and the neck, so body straps would need to emerge close to the neck, then travel away from the head to reach side rails. These changes in direction could limit the ability of the tether to provide quick motion control with minimal free play. It is possible that a completely new shoulder pad system could be designed to accommodate over-the-shoulder strap routing, but exemplary embodiments herein can be easily integrated with most existing helmets and shoulder pads. For conventional shoulder pad systems, these exemplary embodiments provide easier access by implementing a single body strap 510 emerging from the sternum to couple to the front of the facemask 412. Shoulder pads tend to have a lower V-cut in the front, and most pads also comprise left and right halves that are mechanically connected along the sternum line. Similarly, football jerseys have a V-cut in the front, providing a convenient exit point for a central strap 510 to emerge and couple to the helmet 206.

For operation of the side mounted truck 422 (of FIG. 4), the truck 422 freely allows transverse head rotation, but locks during high force, rearward head tilt. Such a truck could be configured, for example with an offset mechanism that binds during downward tension. In contrast, a sliding strap truck (See FIG. 10A truck 1002) interfaced to a curved rail (mandible rail 512) at the front of the helmet 206 would not need any special locking mechanism. During rearward head motion, the truck 422 will stay at the front of the rail 512, as this is the natural minimum tension position for the strap 510. This central, forward truck arrangement therefore is likely to be simpler to engineer, and more likely to function as intended.

Dual rate sensitive straps (also referred to as rate actuated straps) 514 are contained in the body suit 518 in the abdomen/pelvis area, coupled to anchor regions 520 on the pelvis/thighs. The dual tethers 514 meet at a central strap yoke 522, which then connects to a conventional inextensible sternum strap 510 according to these exemplary embodiments. The sternum strap 510 travels over the front of the shoulder pads, through a strap guide 524, to meet the helmet 206. The helmet 206 comprises a mandible rail 512, which can be a composite insert that would slip into the helmet 206 and mount through the sides of the helmet 206 where the chinstrap snaps are conventionally located. The mandible rail 512 can be a rail, track, ring, or the like, and combinations thereof. The sternum strap 510 can be mounted over the mandible rail 512, in the illustrated rendering shown as a fabric loop although a more sophisticated slider is possible. The strap 510 is attached with a snap closure, which can be removed as simply as a conventional chinstrap. The sternum strap 510 can slide over the mandible rail 512, so that side-to-side (transverse plane) head motion has little impediment. Under sagittal head tilt, the sternum strap 510 is tensioned and induces load in the tethers 514.

Figure 6:
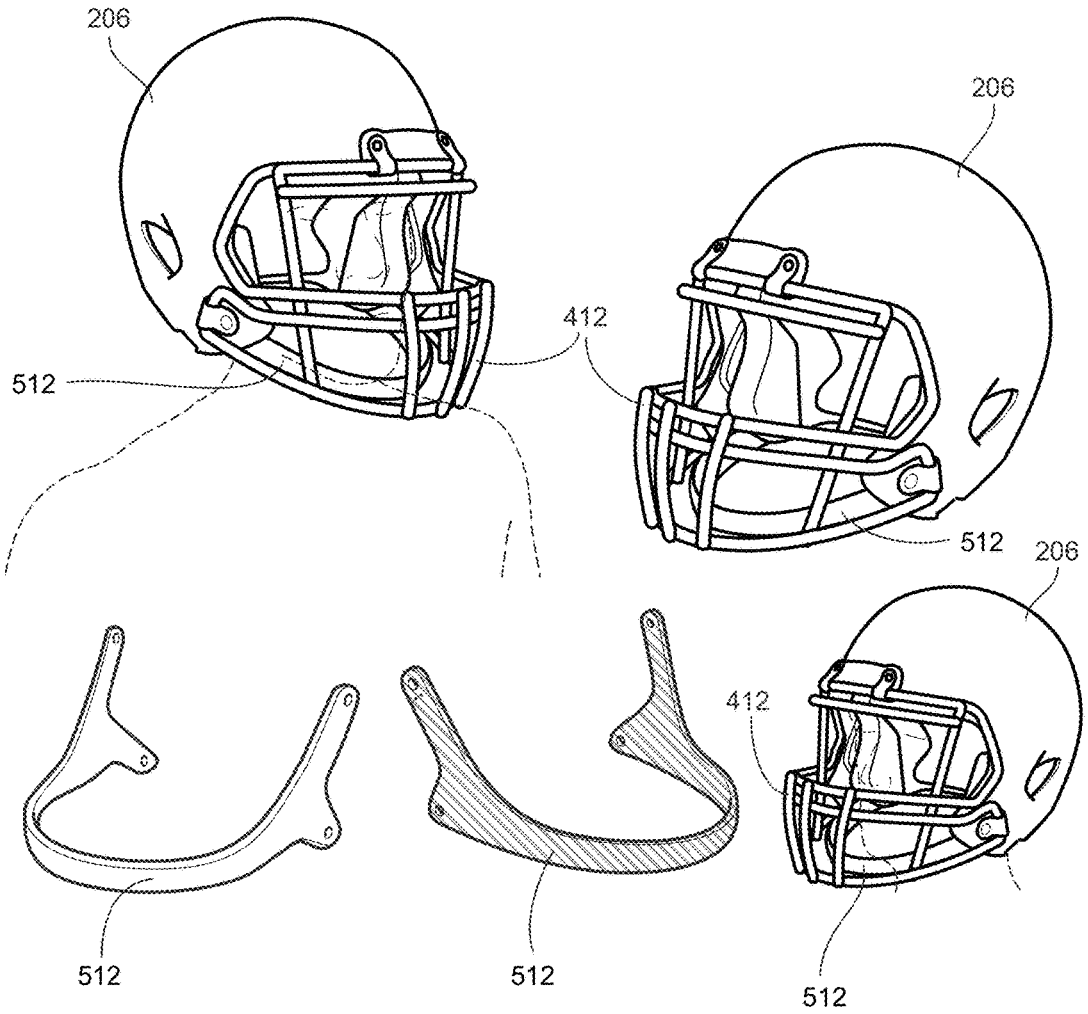
FIG. 6 shows schematic views of a mandible ring connected to a helmet between a lower portion of the facemask and a user's face according to exemplary embodiments herein.

FIG. 6, with reference to FIGS. 1A through 5C, shows a schematic of a mandible rail 512 connected to a helmet 206 between a lower portion of the facemask 412 and a user's face according to exemplary embodiments herein. FIG. 6 further shows isolated views of the mandible rail 512. Other embodiments can include a mandible rail 512 manufactured by wrapping an ABS plastic core with carbon fiber composite, or by using a mold to create a solid composite part. In some of these embodiments, the mandible rail 512 comprises a carbon fiber composite to provide a lightweight, stiff structure.

The system 500, as described herein, does not require any helmet modification, only insertion and fastening the mandible rail 512. According to some of these embodiments, the system 500 comprising the mandible rail 512 can also comprise a chin strap or comprise no chin strap. Such a system with no chin strap can use the tension in the tethering system to keep the helmet 206 firmly pulled against the head of a user. Eliminating the chinstrap can enhance wearer comfort, improve communication, and may even reduce head accelerations during frontal helmet-to-helmet impacts. In the embodiments shown in FIGS. 5A and 5B, only a sternum strap 510 is shown, which alone may not be sufficient to keep the helmet in place. Accordingly, a second, spinal strap 526 to maintain balanced downward force on the helmet 206 is provided and shown in FIG. 5C. This first connector strap 526 is shown to interface to a rear composite yoke 516, which would slide on the facemask rail 410 with an optional helmet raised central band 416 support as described above.

Figure 7A:
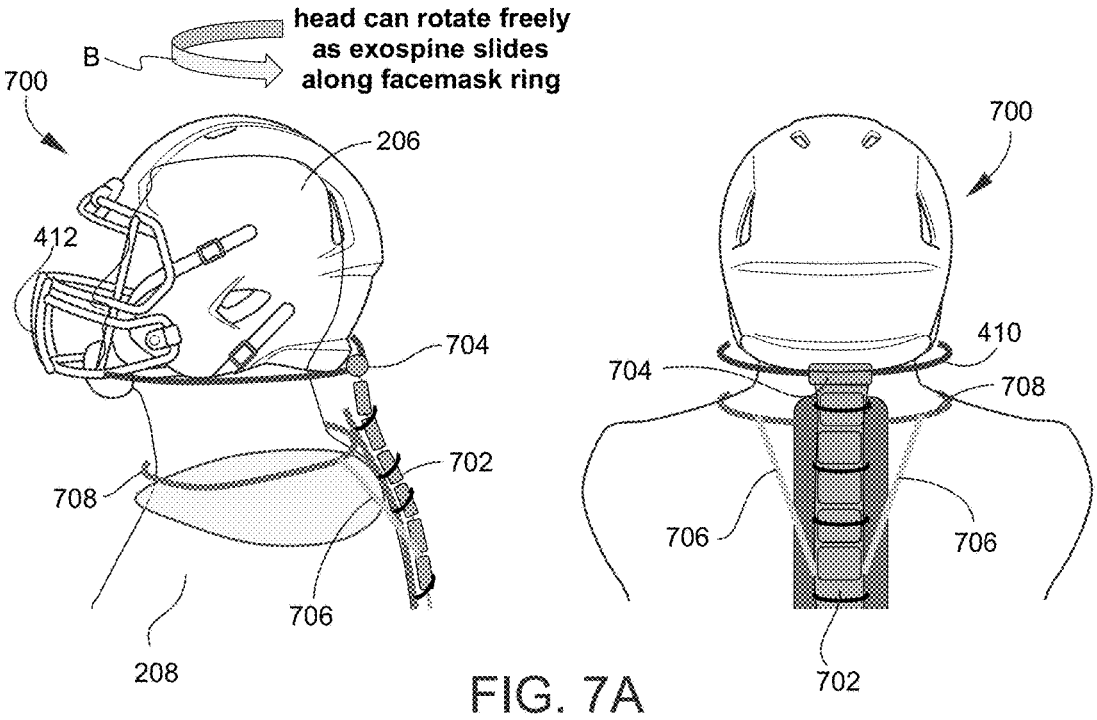
FIG. 7A shows a schematic view of a head restraint system to reduce head concussions according to exemplary embodiments herein.
Figure 7B:
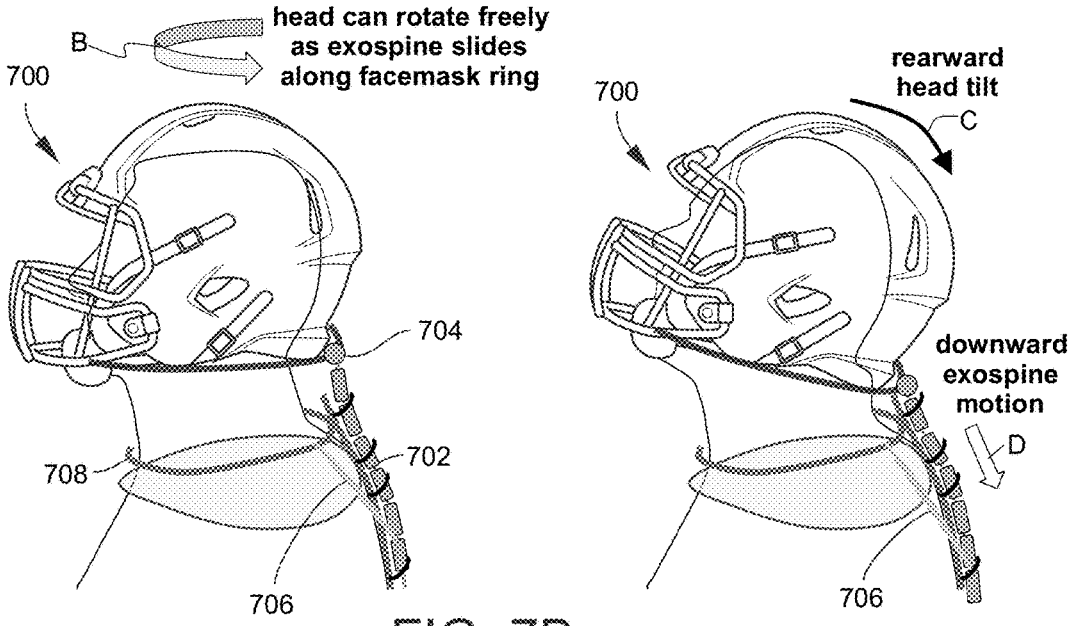
FIG. 7B shows a schematic view illustrating operation of the head restraint system of FIG. 7A.

FIGS. 7A through 7B, with reference to FIGS. 1A through 6, illustrate other views of a head restraint system 700 according to an embodiment herein. FIG. 7A presents a schematic of a head restraint system 700 to reduce head concussions according to exemplary embodiments herein. FIG. 7B illustrates operation of the head restraint system 700 of FIG. 7A. According to the illustrated embodiment, head motion is controlled with an exospine 702 as the first connector that couples to a helmet facemask ring 410 at a sliding coupler 704, which connects to the facemask 412. The head of the user is permitted to rotate freely (e.g., in twist direct "B" shown in FIGS. 7A and 7B) as the exospine 702 slides along the facemask ring 410. The exospine 702 can be flexible, but resistant to longitudinal compression, and can be coupled to the body 208 via a pair of rate activated tethers 706 as the second connector. The rate activated tethers 706 can be anchored to the body by a body yoke 708 or body suit as described above. If the helmet 206 is tilted rearward in direction of arrow "C" as shown in FIG. 7B, it forces the exospine downward in direction of arrow "D", which causes the tethers 706 to extend. Because the tethers 706 are rate-sensitive in some of these embodiments, rearward head tilt will not be resisted at low speeds, but would be resisted with high force at high speeds. One aspect of this exemplary embodiment is that the tethers 706 and other mechanical components are located primarily behind the wearer, creating less bulk in the front of the wearer which could impede motion. In addition, the spine is naturally aligned with the back of the head, creating a straight and direct load path from the helmet 206 through the exospine 702 to the body 208. In contrast, since the chin and face of a wearer protrudes forward past the chest, a front-mounted linkage may need to curve away from the body which could introduce load path inefficiencies.

According to another exemplary embodiment herein onset of a backward fall can be detected, either mechanically or electronically, and this detection can be used to trigger a transition in the tether system response. For example, a mechanical switch (not shown) can be disposed on the back of the user so that, when compressed such as during a backwards fall, it engages a linkage (not shown) that transforms the tether system to a highly resistive configuration. An exemplary embodiment of such a system comprises a mechanical linkage that triggers a mechanical cable-clutch system (not shown) to lock by engaging a locking pin (not shown). Alternatively or in addition, the backwards fall can be sensed electronically via an orientation, acceleration, gyroscopic, or ground-proximity sensor, or a combination of these sensors (not shown) in some of these embodiments. The detection of the backwards fall and imminent ground impact can electronically trigger an increase in the resistance of the tethering system. For example, in an embodiment a tether system containing magnetorheological or electrorheological fluid can be energized. In another example, an embodiment comprises electromagnetically (e.g., with a solenoid) engaging a locking pin into a cable-and-clutch tether system.

Figure 8A:
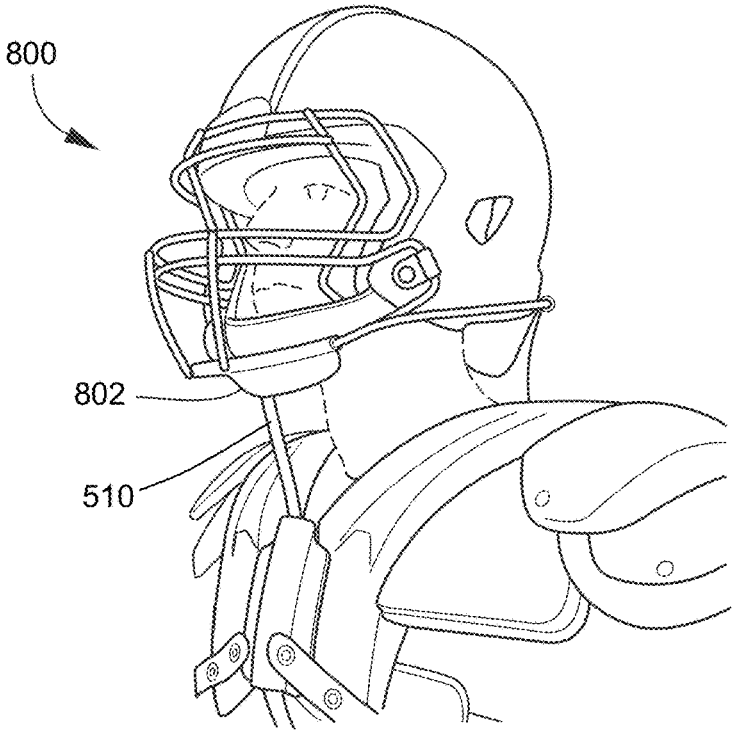
FIGS. 8A and 8B show schematic views of a head restraint system to reduce head concussions according to exemplary embodiments herein.
Figure 8B:
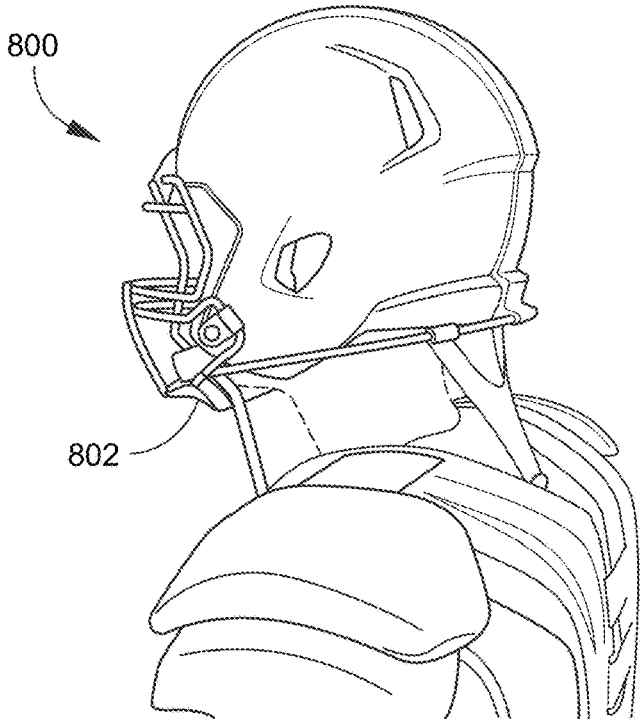

FIGS. 8A and 8B, with reference to FIGS. 1A through 7B, present schematic views of a head restraint system 800 to reduce head concussions according to exemplary embodiments herein. As illustrated in FIGS. 8A and 8B, the head restraint system 800 can comprise a short mandible guide 802 to guide the first connector in a predetermined direction. In this exemplary embodiment, a short mandible strap guide 802 can keep the sternum strap 510 closer to the neck and body of the user, to minimize a snag/grab risk.

Figure 9:
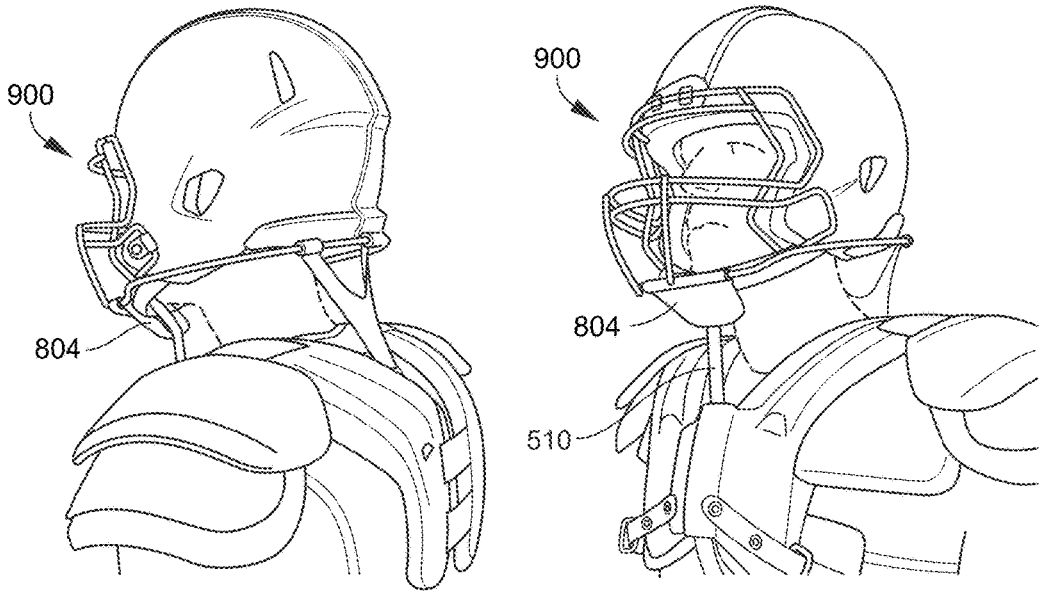
FIG. 9 shows schematic views of a head restraint system to reduce head concussions according to exemplary embodiments herein.

FIG. 9, with reference to FIGS. 1A through 8B, illustrates schematic views of a head restraint system 900 to reduce head concussions according to exemplary embodiments herein. As illustrated in FIG. 9, the head restraint system 900 can comprise a long mandible guide 804 to guide the first connector in a predetermined direction. In this exemplary embodiment, a longer mandible strap guide 804 than shown in FIG. 8 can keep the sternum strap 510 closer to the neck and body of the user.

Figure 10A:
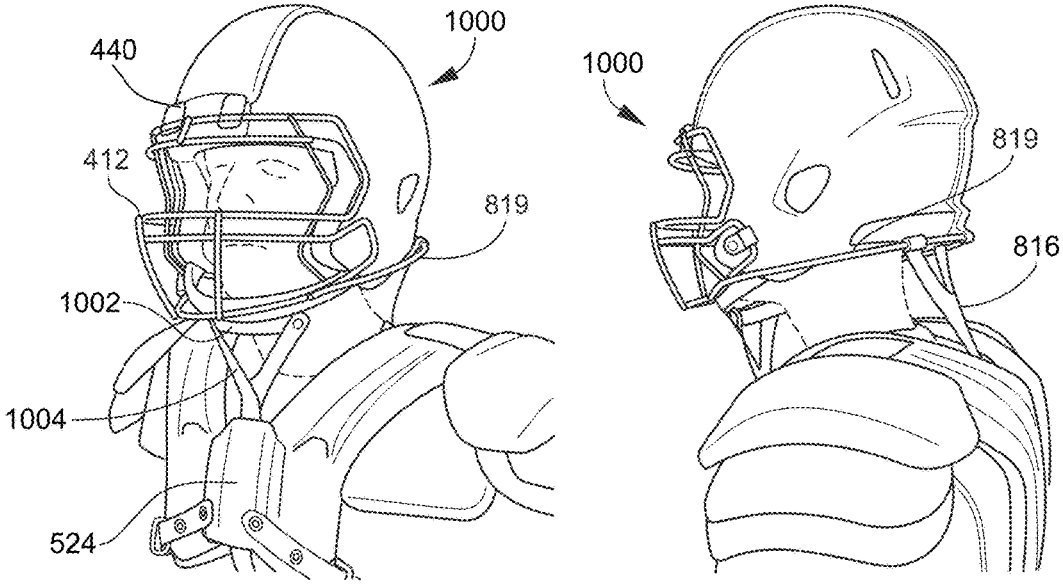
FIGS. 10A and 10B shows schematic views of a head restraint system to reduce head concussions according to exemplary embodiments herein.
Figure 10B:
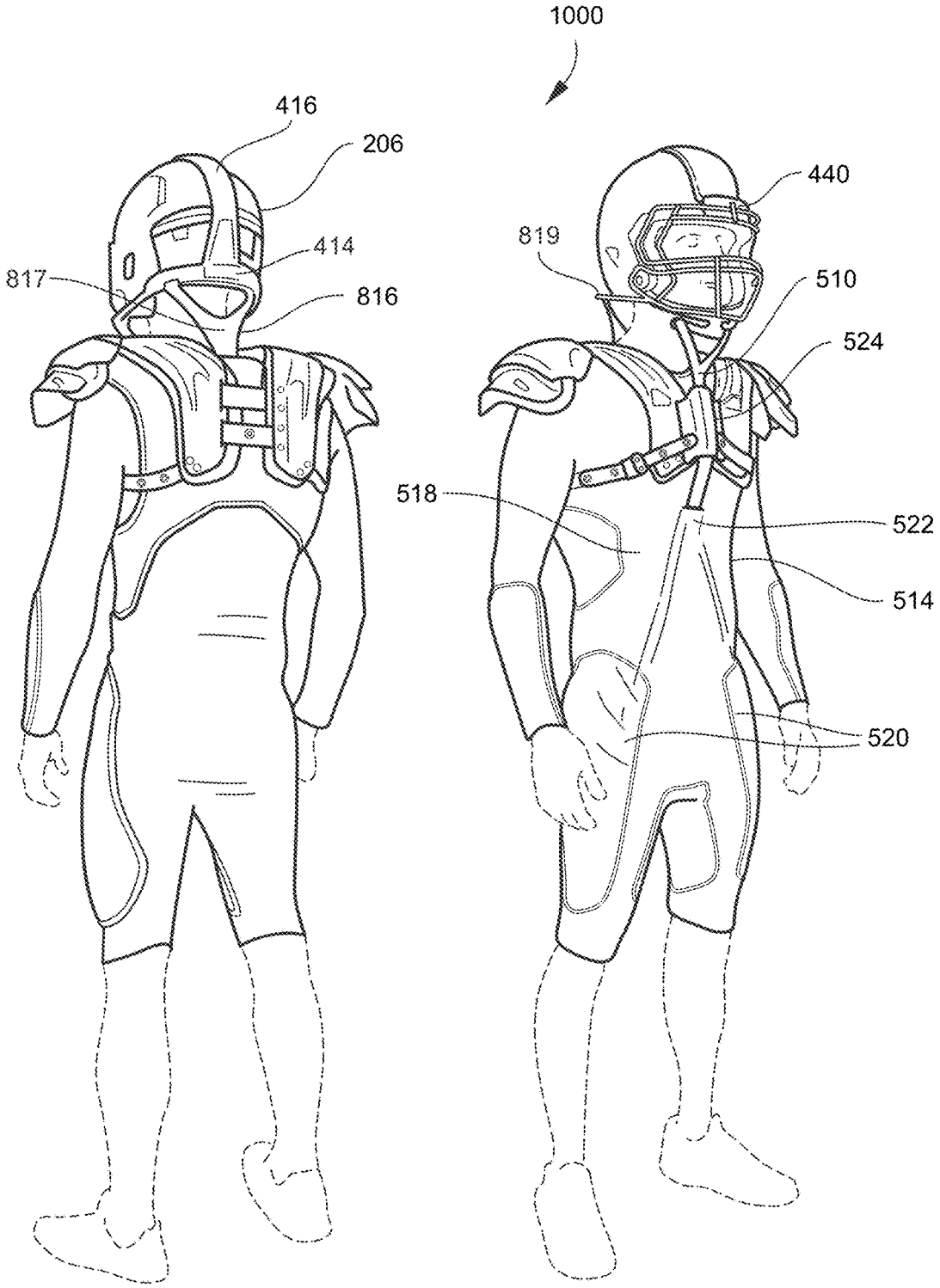

FIGS. 10A and 10B, with reference to FIGS. 1A through 9, are schematic views of a head restraint system 1000 to reduce head concussions according to exemplary embodiments herein. A first connector (strap) 510 is provided comprising a first yoke 1004 and a truck 1002 connected to a user's helmet 206 via a mandible ring 512 in the front and a rear first connector 816 comprising a second yoke 817 connected to a helmet ring 819, the helmet ring 819 being attached to the facemask 412 in the front of the helmet 206 and a support 414 on a posterior portion of a raised central band 416 that extends along the outer surface of the helmet 206 in the sagittal plane to connect to the top 440 of the facemask 412 in the front of the helmet 206 according to some of these exemplary embodiments. The front first connector 510 is connected at a third yoke 522 to a front second connector 514 after passing through a guide 524 at the sternum position of the body suit 518. The front second connector 514 comprises two rate sensitive tethers mounted within the body suit 518 that connect to load anchors 520 of the body suit 518, such as load anchoring in the pelvis. The rear first connector 526 can connect to a rear second connector that connects to load anchors of the body suit 518, such as load anchoring in a shoulder armpit region. The first yoke 1004 couples to a first truck 1002 that can slide on the mandible rail 512.

FIGS. 11A through 11F, with reference to FIGS. 1A through 10B, show schematic side views of head restraint systems 1100 to reduce head concussions according to additional exemplary embodiments herein. According to some of these exemplary embodiments a front rate sensitive device embodied as a second connector 304 can be connected to the front of the helmet 206, for example, at the facemask 412 or a mandible rail 512 (of FIGS. 5A and 5B), by a first connector 310 and/or the front rate sensitive device as a second connector 304 can be connected to the back of the helmet 206, for example, at the helmet ring 410 (of FIG. 4), by a first connector 310. For example, the front rate sensitive device as a second connector 304 can be connected to the front and back of the helmet 206, by both first connectors 310.

According to some of these exemplary embodiments a rate sensitive device 304 can be connected to a shoulder collar 1102 to connect to the body 208, for example, a rigid shoulder collar 1102 and can pass through a loop 1104 at the rear of the helmet. Such a loop allows the head to turn freely side-to-side (rotation in the transverse plane of the head) without requiring strap extension.

Figures 11A, 11B, 11C, 11D, 11E, 11F:
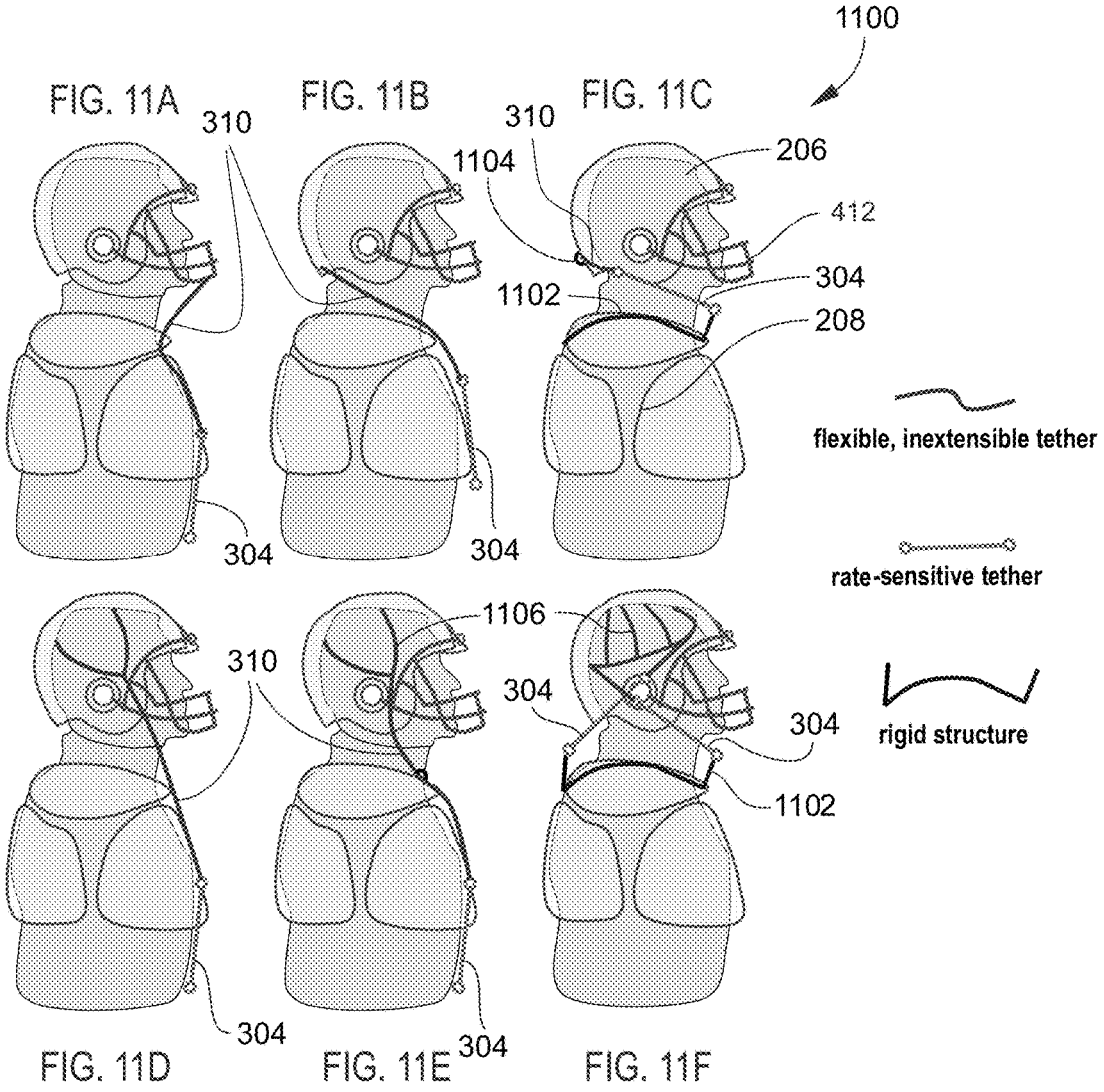
FIGS. 11A through 11F show schematic side views of head restraint systems to reduce head concussions according to additional exemplary embodiments herein.

FIGS. 11D, 11E, and 11F illustrate exemplary embodiments where the tether system is directly connected to the user's head. For example, a head net 1106, a head yoke, a head strap, or the like, and combinations thereof can connect the head to a first connector 310, and the first connector 310 can be connected to a second connector 304, which can be connected to the body 208 as previously described.

Figure 12:
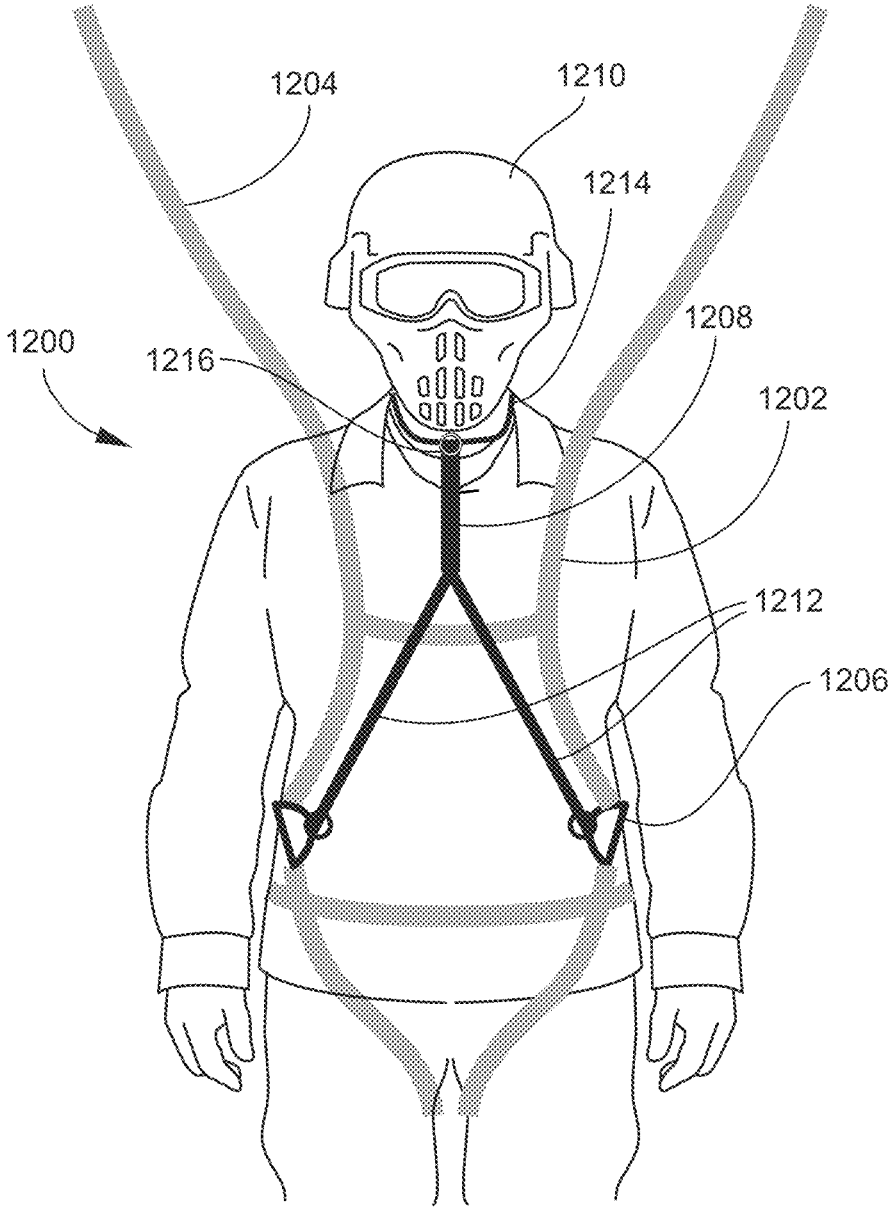
FIG. 12 shows a schematic view of another head restraint system to reduce head concussions according to exemplary embodiments herein.

FIG. 12, with reference to FIGS. 1A through 11F, illustrates an embodiment for soldiers, specifically paratroopers. Paratroopers tend to suffer a higher rate of concussion compared to other soldiers, due to head-to-ground impacts during parachute landing falls. In FIG. 12, a paratrooper 1200 is depicted is wearing a standard body harness 1202 that attaches to the parachute cords 1204. D-shaped mounting rings 1206 for connecting an auxiliary parachute or other equipment are integral to a standard parachute body harness. In this illustrated embodiment, a flexible inextensible strap 1208 forms a connector between the helmet 1210 and two flexible rate sensitive straps 1212. These rate sensitive straps 1212 are anchored to the body suit via the D-rings 1206. A railing system including a mandible rail 1214 may be integral to the helmet 1210 for connection to the inextensible strap 1208. In this regard, the inextensible strap 1208 couples to the mandible rail 1214 with a sliding mount ring 1216 that can slide along the mandible rail 1214 with low resistance. During descent, the paratrooper 1200 is able to move his head around at moderate speeds for good visibility and situational awareness. During the parachute landing fall and ground contact, the rate sensitive system inhibits violent head motions and reduces the likelihood of a violent head-to-ground impact.

EXAMPLES

Exemplary embodiments herein are further described below with respect to certain exemplary and specific embodiments thereof, which are illustrative only and not intended to be limiting. In accordance with some of the embodiments, three representative backfall experiments were performed to reproduce full head and neck motion observed in football backfall events. Table 1 summarizes the results. As provided in Table 1 maximum acceleration data in units of g (acceleration due to gravity, or g force) is shown for baseline (no tether), empty tether (no Shear-thickening Fluid (STF) inside the tether tube), and STF-tether according to exemplary embodiments herein experiments. Data is shown for x, y, and z directions where z is up through the top of the helmet, x is in a direction toward the back of the helmet and the xz plane is the sagittal plane of the head, y is perpendicular to the xz plane such that a rotation of the head nodding up and down is approximately a rotation about the y axis. The resultant values (maximum resultant as calculated at each time instant) and the average and standard deviation values are shown in Table 1, as well.

TABLE 1

| | X | Y | Z | RES |
|---|---|---|---|---|
| | Baseline | | | |
| 1 | −95.64 | 7.42 | 47.28 | 99.51 |
| 2 | −95.87 | 3.25 | 46.64 | 99.49 |
| 3 | −94.85 | −2.63 | 47.27 | 97.78 |
| AVG | −95.45 | 2.68 | 47.06 | 98.93 |
| STDEV | 0.44 | 4.12 | 0.30 | 0.81 |
| | Empty Tether | | | |
| 4 | −92.63 | 5.24 | 42.12 | 96.26 |
| 5 | −98.29 | −4.68 | 46.81 | 100.76 |
| 6 | −91.10 | 4.48 | 43.82 | 93.83 |
| AVG | −94.00 | 1.68 | 44.25 | 96.95 |
| STDEV | 3.09 | 4.51 | 1.94 | 2.87 |
| | STF Tether According to Exemplary Embodiments | | | |
| 7 | −48.50 | −3.26 | 52.88 | 58.40 |
| 8 | −44.79 | 2.21 | 47.97 | 48.29 |
| 9 | −39.66 | 2.62 | 47.21 | 51.29 |
| AVG | −44.32 | 0.52 | 49.35 | 52.66 |
| STDEV | 3.63 | 2.68 | 2.51 | 4.24 |

Figure 13:
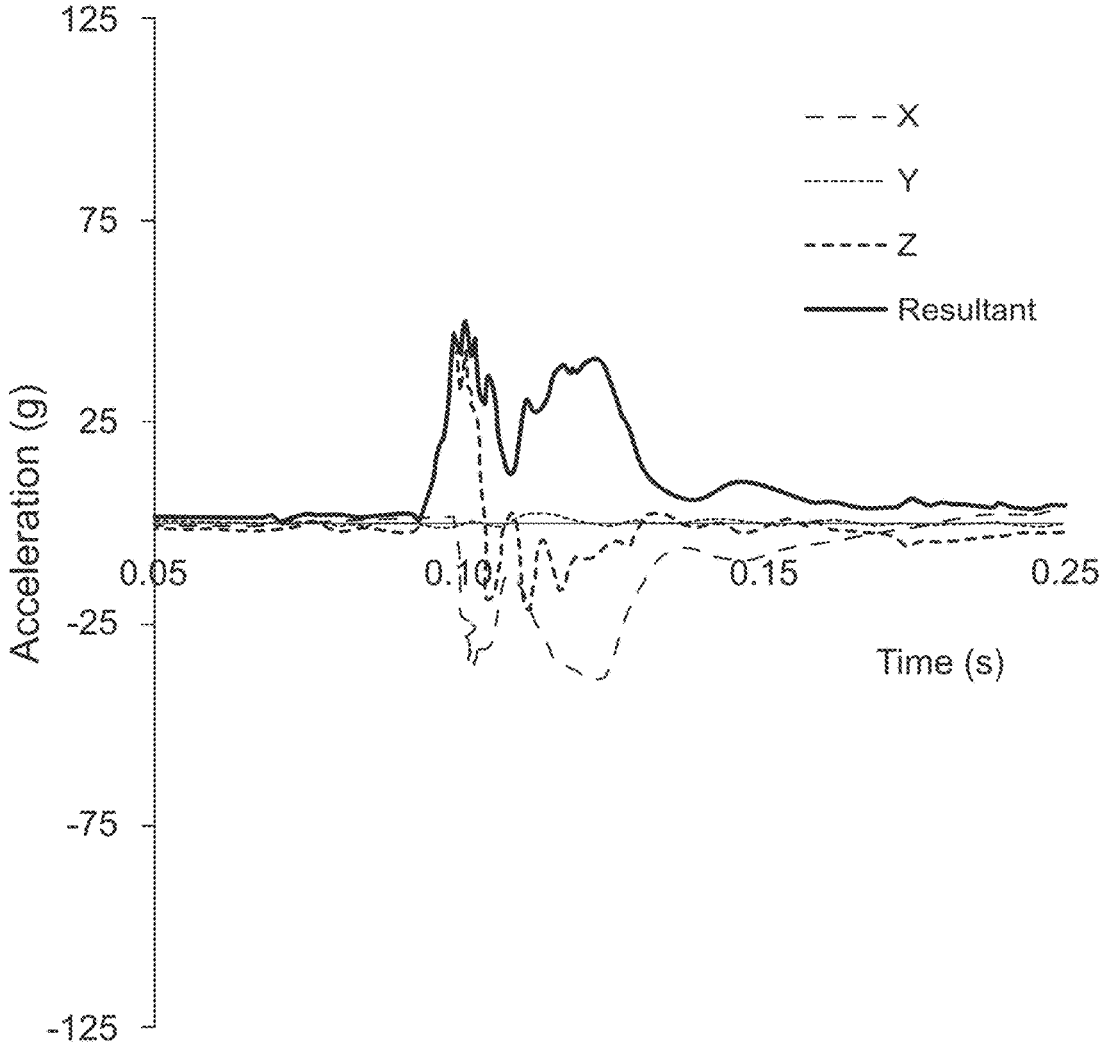
FIG. 13 is a graph illustrating acceleration-time data for a representative experiment performed to reproduce full head and neck motion observed in football backfall events.
Figure 14:
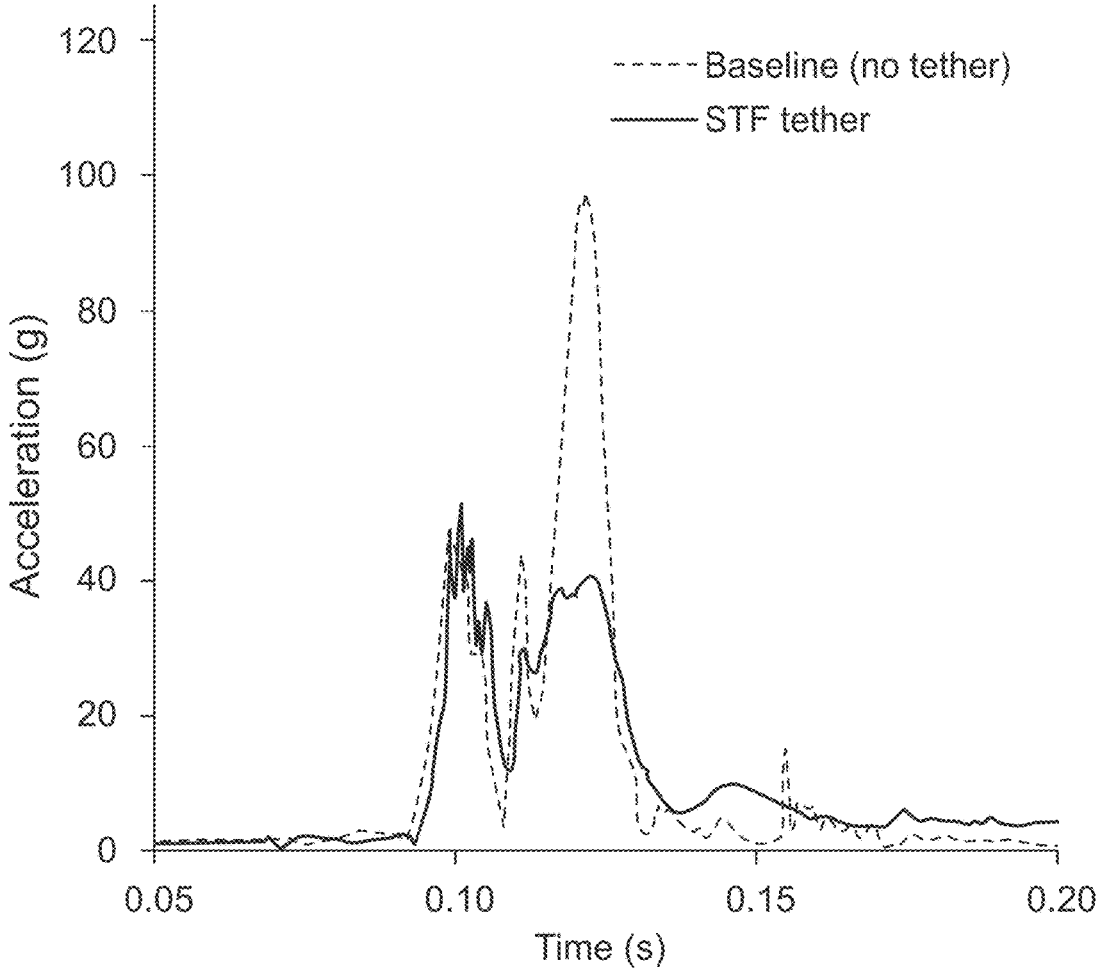
FIG. 14 is a graph illustrating comparison resultant accelerations for baseline and shear thickening fluid (STF)-tether cases directly.

Acceleration-time data for the representative experiment, whose data is provided in Table 1, is shown in FIG. 13. FIG. 14 compares resultant accelerations for Baseline and STF-tether cases directly. The STF tethers have resulted in a dramatic decrease in peak acceleration during the head-to-ground impact. The STF tether acts to limit head excursion, especially head rotation, which reduces the velocity and impact force of the rear of the helmet with the ground. In these experiments, the comparison of Baseline, Empty Tether, and STF-tether according to exemplary embodiments herein demonstrates that the STF-tether system is able to reduce peak head accelerations during a reproduced backfall event from 99 g to 53 g, and that this reduction in peak acceleration is directly due to the rate-activated behavior of the STF-tether according to exemplary embodiments herein. As shown in FIG. 14, the peak acceleration during head-to-ground impact is significantly lower when a STF-tether is used in accordance with the embodiments herein. In fact, the baseline peak acceleration value (i.e., no STF-tether) is approximately 99 g while the STF-tether peak acceleration value is approximately 53 g.

According to exemplary embodiments herein, a system for coupling the head to the body with rate-activated tethers configured to prevent concussions is provided. In some of these embodiments, the rate-activated tethers comprise, in part, a shear thickening fluid. In some of these embodiments, the rate-activated tethers comprise an elastically-deformable confinement member, internal filaments, and enclosed shear thickening fluid. In some of these embodiments, the rate-activated tethers comprise, in part, an inertial clutch. In some of these embodiments, the rate-activated tethers are arranged in series with inextensible tethers to create a tether ensemble.

According to some exemplary embodiments herein, the system for coupling the head to the body with rate-activated tethers can include the end or ends of the tether ensemble coupled to the helmet of the wearer. In some of these embodiments, the tether ensemble (combination of rate-activated and/or inextensible tethers) is connected to a sliding truck that slides on a rail attached to the helmet. In some of these embodiments, the rail is curved and positioned between the facemask and face of the wearer, and is mechanically coupled to the helmet shell. In some of these embodiments, the rail is made of metal, polymer, or fiber-reinforced polymer. In some of these embodiments, the rail is curved and integral to the facemask, and travels in a substantially circular arc around helmet in the transverse plane of the head. In some of these embodiments, the rail is composed of metal, polymer, or fiber-reinforced polymer. In some of these embodiments, the rail is partially supported by mechanical attachment points to the helmet shell. In some of these embodiments, some of the mechanical supports for the rail are integral to the helmet shell. In some of these embodiments, the mechanical supports for the rail are add-on structures that are mechanically attached to a conventional helmet-shell. In some of these embodiments, the mechanical support comprises a helmet raised central band that conforms to the helmet shell, and is substantially positioned in the sagittal plane of the head ("mohawk"). In some of these embodiments, the helmet mohawk contains energy-absorbing materials such as foam, honeycomb, or trusses. In some of these embodiments, the helmet mohawk is composed of metal, polymer, or polymer composite.

According to some of these exemplary embodiments herein, the truck is configured into a yoke, with two points of sliding attachment on the rail, and one point of attachment to the tether ensemble. In some of these embodiments, the truck is configured into an inverted yoke, with one point of sliding attachment on the rail, and two points of attachment to the tether ensemble.

According to some exemplary embodiments herein, the system for coupling the head to the body with rate-activated tethers can include the end or ends of the tether ensemble coupled to a body-worn garment ("body suit" or "garment"). In some of these embodiments, the tether ensemble rides within guides integral to the body-worn garment that encourage the tether ensemble to follow the contours of the body. In some of these embodiments, the body-worn garment includes rate-sensitive fitting straps that lengthen to allow comfort, but become much more resistive to lengthening when sudden load is applied. In some of these embodiments, the rate-sensitive fitting straps comprise, in part, a shear thickening fluid. In some of these embodiments, the rate-sensitive fitting straps are constructed from an elastically-deformable confinement member, internal filaments, and enclosed shear thickening fluid. In some of these embodiments, the rate-sensitive fitting straps comprise, in part, an inertial clutch. In some of these embodiments, the body-worn garment is mechanically coupled to the pelvis, hips, or thighs of the wearer. In some of these embodiments, the mechanical coupling is accomplished with adjustable straps. In some of these embodiments, the mechanical coupling is accomplished with a textile sock that tightens to the body when placed under tension.

According to some exemplary embodiments herein, the system for coupling the head to the body with rate-activated tethers can include the tether ensemble routed along the front of the body and/or along the back of the body. In some of these embodiments, the tether ensemble is routed along the sides of the body.

According to some exemplary embodiments herein, in the system for coupling the head to the body the rate-activated tethers can include mechanically triggered tethers. In some of these embodiments, a mechanism positioned on the back of the wearer causes the mechanically triggered tethers to transform to a highly resistive state when the mechanism makes contact with the ground. In some of these embodiments, the tethers are electronically triggered tethers. In some of these embodiments, an orientation sensor in the system creates an electronic signal that transforms the electronically triggered tethers to a highly resistive state when the sensor detects that the wearer is oriented in a backward-falling position.

According to some exemplary embodiments herein, the system can include an acceleration sensor to create an electronic signal that transforms the electronically triggered tethers to a highly resistive state when the sensor detects that the wearer is falling backward. In some of these embodiments, a gyroscopic sensor in the system creates an electronic signal that transforms the electronically triggered tethers to a highly resistive state when the sensor detects that the wearer is falling backward. In some of these embodiments, a proximity sensor in the system creates an electronic signal that transforms the electronically triggered tethers to a highly resistive state when the sensor detects that the wearer's back is in close proximity to the ground.

In some of these embodiments, the electronically triggered tethers comprise, in part, a magnetorheological fluid. In some of these embodiments, the electronically triggered tethers comprise an elastically-deformable confinement member, internal filaments, and enclosed magnetorheological fluid. In some of these embodiments, the electronically triggered tethers comprise, in part, an electrorheological fluid. In some of these embodiments, the electronically triggered tethers comprise an elastically-deformable confinement member, internal filaments, and enclosed electrorheological fluid. In some of these embodiments, the electronically triggered tethers comprise, in part, an electromagnetically actuated mechanical clutch. In some of these embodiments, the electronically triggered tethers comprise, in part, an electromagnetic clutch.

According to some exemplary embodiments herein, the system for coupling the head to the body with rate-activated tethers can include the tether ensemble coupled to the helmet via a flexible, incompressible, inextensible structure positioned substantially parallel to the spine along the back of the wearer. In some of these embodiments, the flexible structure comprises of a series of stiff and flexible segments. In some of these embodiments, the flexible structure rides within guides integral to the body-worn garment that encourage the flexible structure to follow the contours of the body. In some of these embodiments, the tether ensemble is coupled to the thorax, neck, or shoulders of the wearer.

According to some exemplary embodiments herein, the system for coupling the head to the body with rate-activated tethers can include the tether ensemble coupled to the helmet via an inextensible strap that passes through, and slides easily within, a guide on the helmet. In some of these embodiments, the tether ensemble is coupled to the body via a rigid structure mounted to the thorax, neck, or shoulders of the wearer. In some of these embodiments, the end or ends of the tether ensemble are coupled to the head of the wearer by a garment worn directly on the head. In some of these embodiments, the head-worn garment is an array of inextensible straps. In some of these embodiments, the head-worn garment comprises a knitted, braided, or woven fabric.

According to some exemplary embodiments herein, the system for coupling the head to the body with rate-activated tethers can be configured to control head motion of a user during sports. For example, the system can be configured to control head motion of a user during football, hockey, biking, skateboarding, or lacrosse. For example, the system can be configured to control head motion of a user during motorsports. For example, the system can be configured to control head motion of a user during auto racing or motorbike racing. For example, the system can be configured to control head motion of a user during parachute landing falls, or in other types of applications.

The types of motion to be restrained or not restrained, and threshold velocities for triggering restraint, are likely to vary depending on the application. For example, in some instances a linear velocity or acceleration is to be restrained, while in other cases a rotation velocity or acceleration is to be restrained, while in other cases both linear and rotational motions are to be restrained simultaneously. As another example, a system designed for youth football might wish to restrain any head motions greater than 0.5 m/s (relative to the body), while a system for professional football might wish to restrain head motions greater than 1 m/s, to accommodate the quicker motion of an adult professional player compared to a youth. As another example, for an oval racing application a system might be desired in which head motion is unrestrained for speeds less than 0.1 m/s, while a system for a hockey application might be desired in which head motion is unrestrained for speeds less than 0.5 m/s. In this comparison, slower head motions are anticipated in auto racing on an oval track, while in hockey a more rapid free head motion is required for maximum agility during quick gameplay. Generally, while general linear and rotational velocity thresholds can be broadly anticipated, the detailed specifications for threshold velocities will depend on the application, and the material properties and system geometric details can be customized to accommodate a wide range of motion control and threshold velocities.

As an example, the relative motion of the head relative to the body may comprise a head rotation in any of a transverse, sagittal, and frontal plane, wherein the first velocity and the second velocity comprise an angular velocity. The first velocity may be less than approximately 2.5 rad/s, and the second velocity may be greater than approximately 5 rad/s. Alternatively, the first velocity may be less than approximately 5 rad/s, and the second velocity may be greater than approximately 0.5 rad/s. Still alternatively, the first velocity may be less than approximately 25 rad/s, and the second velocity may be greater than approximately 0.25 rad/s.

As another example, the relative motion of the head relative to the body may comprise a linear displacement of the head relative to the body, wherein the first velocity and the second velocity comprise a linear velocity. The first velocity may be less than approximately 0.5 m/s, and the second velocity may be greater than approximately 1 m/s. Alternatively, the first velocity may be less than approximately 1 m/s, and the second velocity may be greater than approximately 0.1 m/s. Still alternatively, the first velocity may be less than approximately 5 m/s, and the second velocity may be greater than approximately 0.05 m/s.

According to some exemplary embodiments herein, the system for coupling the head to the body with rate-activated tethers can be configured to control head motion of a user during military activities. For example, the system can be configured to control head motion of a user during parachute landing falls. For example, the system can be configured to control head motion of a user during blast or ballistic loading.

According to some exemplary embodiments herein, the system for coupling the head to the body with rate-activated tethers can include the tether routed to the head via a helmet-mounted guide that positions the tether closer to the neck and body. In some of these embodiments, the tether is split so that one or more tethers are each split into two or more connection points to the helmet. In some of these embodiments, the tether is split so that one or more tethers are each split into two or more connection points to the body. According to some of these exemplary embodiments herein, the helmet comprises a football helmet.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A head restraint system comprising:

a first connector configured to operatively connect to a head of a user; and a second connector operatively connected to said first connector and configured to operatively connect to a body of said user, wherein any of said first connector and said second connector comprises a flexible rate sensitive device, the flexible rate sensitive device comprising: an elastically-deformable confinement member, a shear thickening fluid enclosed by the elastically-deformable confinement member, and internal filaments extending into the shear thickening fluid which when displaced create shear in the shear thickening fluid, wherein, due to differing degrees of fluid shearing which may be created within the flexible rate sensitive device due to motion of the second connector relative to the first connector, said first connector and said second connector are configured to not restrain relative motion between said head and said body during a motion of a first velocity, and to restrain relative motion between said head and said body during a motion of a second velocity, and wherein said motion of said second velocity is greater than said motion of said first velocity.

2. The system of claim 1, wherein the other one of said first connector and said second connector comprises an inextensible device.

3. The system of claim 1, further comprising a helmet configured to be disposed on said head of the user, wherein said first connector is operatively connected to said helmet.

4. The system of claim 3, further comprising:

a rail connected to said helmet; and a mechanism slideably coupled to said rail, wherein said first connector is operatively connected to said mechanism.

5. The system of claim 4, further comprising a facemask operatively connected to said helmet, wherein said rail comprises a curved section and is disposed between said facemask and a face position of the user when said helmet is disposed on said head of the user.

6. The system of claim 4, further comprising a facemask operatively connected to said helmet, wherein said rail comprises a curved section, is operatively connected to said facemask, and extends around said helmet in a transverse plane of said helmet.

7. The system of claim 6, further comprising at least one rail support to operatively connect said rail to said helmet at another location.

8. The system of claim 7, wherein said at least one rail support comprises a helmet raised central band that conforms to an outer surface of said helmet, and is disposed in substantially a sagittal plane of said helmet.

9. The system of claim 8, wherein said helmet raised central band comprises an energy-absorbing element disposed on an outer surface of said helmet, and wherein said energy absorbing element comprising at least one of foam, honeycomb walls, and trusses.

10. The system of claim 4, wherein said mechanism comprises a yoke comprising a plurality of first attachments slideably disposed on said rail, and a second attachment opposed to said plurality of first attachments operatively connected to said first connector.

11. The system of claim 4, wherein said first connector comprises a plurality of first connectors, and wherein said mechanism comprises a yoke comprising a first attachment slideably connected to said rail, and a plurality of second attachments each connected to said first connector, and opposed to said first attachment.

12. The system of claim 1, wherein said second connector operatively connects to a garment configured to be worn on said body of the user.

13. The system of claim 12, wherein said garment comprises a sheath, wherein at least one of said first connector and the second connector is movably disposed in said sheath, and wherein said sheath is configured to guide the at least one of said first connector and said second connector along body contours of the user.

14. The system of claim 12, wherein said garment comprises said flexible rate sensitive device that is configured to lengthen at a first predetermined loading rate and resist lengthening at a second predetermined loading rate, wherein said first predetermined loading rate is lower than said second predetermined loading rate, and wherein said flexible rate sensitive device comprises a strap.

15. The system of claim 14, wherein said garment comprises a body connector configured to couple to at least one of a shoulder, a ribcage, a thorax, a waist, a pelvis, a hip, and a thigh of the user.

16. The system of claim 15, wherein said body connector comprises at least one of an adjustable strap and a conformal sleeve configured to tighten to said body of the user when placed under tension.

17. The system of claim 12, wherein at least one of said first connector and said second connector is configured to be disposed along at least one of a front of said body of the user, a back of said body of the user, and a side of said body of the user.

18. The system of claim 1, wherein the relative motion of said head relative to said body comprises a head rotation in any of a transverse, sagittal, and frontal plane, and wherein said first velocity and said second velocity comprise an angular velocity.

19. The system of claim 18, wherein said first velocity is less than approximately 25 rad/s, and wherein said second velocity is greater than approximately 0.25 rad/s, so as to reduce concussions due to head impact.

20. The system of claim 1, wherein the relative motion of said head relative to said body comprises a linear displacement of said head relative to said body, and wherein said first velocity and said second velocity comprise a linear velocity.

21. The system of claim 20, wherein said first velocity is less than approximately 5 m/s, and wherein said second velocity is greater than approximately 0.05 m/s, so as to reduce concussions due to head impact.

22. The system of claim 1, wherein the total mass and volume of fluid inside the rate sensitive device remains constant during extension and relaxation.

23. The system of claim 1, wherein the resistance force to extension of the said flexible rate sensitive device increases passively as the extension rate of the device increases based on relative motion of head with respect to the body.

24. The system of claim 23, wherein the flexible rate sensitive device undergoes the increase in resistance without receiving any electrical activation signal.

* * * * *